US007000411B2

(12) United States Patent
Kim et al.

(10) Patent No.: US 7,000,411 B2
(45) Date of Patent: Feb. 21, 2006

(54) APPARATUS FOR CONTROLLING OUTDOOR UNIT'S LOUVER BLADES AND ITS METHOD

(75) Inventors: In-Gyu Kim, Jinhae-Shi (KR); Young-Ju Bae, Changwon-Shi (KR); Ja-Hyung Koo, Changwon-Shi (KR); Byung-Il Park, Changwon-Shi (KR); Kyeong-Ho Kim, Changwon-Shi (KR); Yang-Ho Kim, Changwon-Shi (KR); Young-Ho Hong, Kimhae-Shi (KR); Kyeong-Wook Heo, Changwon-Shi (KR); Kang-Wook Cha, Changwon-Shi (KR); Si-Kyong Sung, Changwon-Shi (KR); Dong-Hyuk Lee, Jinhae-Shi (KR); Seong-Min Kang, Seoul (KR); Tae-Geun Kim, Changwon-Shi (KR)

(73) Assignee: LG Electronics Inc., Seoul (KR)

( * ) Notice: Subject to any disclaimer, the term of this patent is extended or adjusted under 35 U.S.C. 154(b) by 63 days.

(21) Appl. No.: 10/473,002

(22) PCT Filed: Jun. 9, 2003

(86) PCT No.: PCT/KR03/01124

§ 371 (c)(1),
(2), (4) Date: Sep. 26, 2003

(87) PCT Pub. No.: WO04/097307

PCT Pub. Date: Jun. 9, 2003

(65) Prior Publication Data

US 2004/0231347 A1 Nov. 25, 2004

(30) Foreign Application Priority Data

Apr. 30, 2003 (KR) ..... 10-2003-27779
Apr. 30, 2003 (KR) ..... 10-2003-27781
Apr. 30, 2003 (KR) ..... 10-2003-27782
May 15, 2003 (KR) ..... 10-2003-30991

(51) Int. Cl.
*F25B 39/04* (2006.01)
*F24F 13/06* (2006.01)
*F24F 13/04* (2006.01)

(52) U.S. Cl. ..... 62/183; 454/325; 454/335

(58) Field of Classification Search ..... 62/176.6, 62/428, 183, 186; 454/258, 285, 313, 314, 454/315, 318, 325, 326, 335
See application file for complete search history.

(56) References Cited

U.S. PATENT DOCUMENTS 4,621,570 A * 11/1986 Bolton et al. ..... 454/319
4,738,116 A 4/1988 Himeno et al. ..... 62/186
5,251,814 A 10/1993 Warashina et al. ..... 236/49.3
5,850,742 A * 12/1998 Bang et al. ..... 62/89
6,632,136 B1 * 10/2003 Anderson et al. ..... 460/101

FOREIGN PATENT DOCUMENTS

GB 2218800 11/1989
JP 03-213928 9/1991
JP 06-101873 4/1994
JP 2001004192 A * 1/2001
JP 2001174001 A * 6/2001

* cited by examiner

*Primary Examiner*—Chen Wen Jiang
(74) *Attorney, Agent, or Firm*—Fleshner & Kim, LLP

(57) ABSTRACT

An apparatus and method for controlling louver blades of a compressor/condenser unit are provided which can improve efficiency of the compressor/condenser unit based on a position of the louver blades and peripheral conditions. The apparatus includes louver blades with a pair of connecting protrusions formed at each end thereof, and a plurality of levers which are rotatably coupled to the connecting protrusions of the louver blades formed in the same positions. A driving member opens and closes the louver blades by moving the levers, and in turn, the louver blades coupled there to. A microcomputer controls the driving member, and the louver blades are opened and closed based on a control signal from the microcomputer.

10 Claims, 24 Drawing Sheets

APPARATUS FOR CONTROLLING OUTDOOR UNIT'S LOUVER BLADES AND ITS METHOD

TECHNICAL FIELD

The present invention relates to an apparatus and method for controlling louver blades of an outdoor unit, and more particularly to, an apparatus and method for controlling louver blades of an outdoor unit which can improve efficiency of the outdoor unit according to a state of the louver blades and peripheral conditions.

BACKGROUND ART

An air conditioner implying a cooler, a heater or both of them is classified into a window type and a split type. In the case of the cooler, a split type air conditioner includes an indoor unit installed indoors for cooling a room, and an outdoor unit connected to the indoor unit through refrigerant pipe lines and installed outdoors to contact air, for performing condensation heat exchange on a refrigerant gas in a condenser by using external air as a cooling medium, and supplying the condensed refrigerants to an evaporator of the indoor unit through the refrigerant pipe lines. The indoor unit is composed of the evaporator for performing cooling heat exchange for evaporating the refrigerants and absorbing evaporation heat from internal air, and a ventilating fan for circulating internal air, and the outdoor unit is composed of a compressor for compressing the refrigerant gas and supplying the compressed gas to the condenser, the air-cooled condenser for condensing the refrigerant gas from the compressor, and a cooling fan for forcibly ventilating external air to the air-cooled condenser to cool and condense the refrigerant gas. The compressor, the air-cooled condenser and the cooling fan of the outdoor unit are installed in an outdoor unit casing composing the outer appearance. The conventional hexahedral outdoor unit casing has an air suction unit for sucking air to the air-cooled condenser at its three sides, and an air discharge unit for externally discharging air absorbing condensation heat from the refrigerant gas by the heat exchange in the air-cooled condenser on its top surface.

However, the conventional outdoor unit for the air conditioner is restricted in installation spaces due to high density and strict environment regulations of cities, and increases civil applications due to noise and heat. Especially, a common residential area such as large-scaled apartment buildings regulates the outdoor units to be installed in indoor verandas to improve the appearance and prevent noise.

In order to solve the foregoing problems, Japanese Laid-Open Patent Publication 6-101873 suggests an air conditioner mounted building where an indoor unit of an air conditioner is installed indoors or adjacent to a room intended to be air-conditioned, and an outdoor unit of the air conditioner is installed outdoors, wherein an opening is formed on the outer wall or roof, a louver is installed in the opening, the outdoor unit of the air conditioner is positioned in the louver, and suction/discharge of the indoor unit is performed through a gap between louver plates.

In addition, Japanese Laid-Open Patent Publication 3-213928 discloses a wall built-in type outdoor unit for an air conditioner including an outdoor unit main body for the air conditioner which is built in the wall and which includes a frame having the same size and thickness as the wall, a suction hole for heat exchange air installed on the same surface as the outdoor unit main body, and a discharge hole for heat exchanged air.

FIG. 1 is a cross-sectional view illustrating a conventional louver unit. Referring to FIG. 1, the louver unit 1 is divided into a suction area 7*a* and a discharge area 7*b* on a rectangular space inner wall formed on an outer wall 2 of a residential and/or commercial building, and a plurality of louver blades 8 which are externally protruded with the same length are installed in each area.

The suction area 7*a* of the louver unit 1 contacts with a suction unit 11*a* of the outdoor unit, and the discharge area 7*b* of the louver unit 1 contacts with a discharge unit 11*b* of the outdoor unit. That is, air is sucked through gaps between the louver blades 8 of the suction area 7*a*, supplied to the suction unit 11*a* of the outdoor unit, heat exchanged therein, discharged from the discharge unit 11*b* of the outdoor unit, and discharged through gaps between the louver blades 8 of the discharge area 7*b* of the louver unit 1.

However, an open/close operation of the louver blades 8 is interrupted due to external factors (rain, snow, ice, dust, etc.), and thus the louver blades 8 may not be normally operated after an extended period of time.

In addition, the louver blades which have not been used for a long term may have problems due to the external factors.

The conventional outdoor unit does not suggest an apparatus and method for confirming an open/close state of the louver unit 1. Therefore, when the louver unit 1 is not normally operated due to errors, external air is not smoothly sucked through the suction unit 11*a* of the outdoor unit, and discharged through the discharge unit 11*b* of the outdoor unit. As a result, cooling/heating performance of the outdoor unit is rapidly reduced, and thus refrigerants are not efficiently heat exchanged, which has detrimental effects on performance of the indoor unit.

Moreover, when an overload current is transmitted to a driving source for operating the louver blades, the louver blades are closed or a driving member is out of order due to the overload current, to interrupt the operation of the outdoor unit.

In addition, mis-operations of sensors or switches of the outdoor unit are not sensed. Accordingly, the outdoor unit may not be normally operated.

The louver unit of the outdoor unit maintains a constant open angle of the louver blades to open or close the louver blades. As illustrated in FIG. 1, the louver blades opened by about 45° can intercept rain drops in a rainy day (100% of humidity). However, when external humidity is low, for example in a sunny day, such an angle increases a fan resistance, to interrupt suction/discharge of air.

DISCLOSURE OF THE INVENTION

An object of the present invention is to provide an apparatus and method for controlling louver blades of an outdoor unit which can decide a long term non-use state of the louver blades which may interrupt an open/close operation of the louver blades.

Another object of the present invention is to provide an apparatus and method for controlling louver blades of an outdoor unit which can idle the louver blades at certain intervals of time in order to prevent errors of the louver blades which have not been used for a long term due to external factors.

Yet another object of the present invention is to provide an apparatus and method for controlling louver blades of an outdoor unit which can confirm an open/close state of the louver blades.

Yet another object of the present invention is to provide an apparatus and method for controlling louver blades of an outdoor unit which can confirm whether the louver blades are normally opened.

Yet another object of the present invention is to provide an apparatus and method for controlling louver blades of an outdoor unit which can notify an operation state of the louver blades to an indoor unit in order to display the operation state for the user.

Yet another object of the present invention is to provide an apparatus and method for controlling louver blades of an outdoor unit which can normally operate the outdoor unit even when an overload current is applied to a driving source for operating the louver blades.

Yet another object of the present invention is to provide an apparatus and method for controlling louver blades of an outdoor unit which can normally operate the outdoor unit by sensing a mis-operation of sensors or switches of the outdoor unit relating to the operation of the louver blades.

Yet another object of the present invention is to provide an apparatus and method for controlling louver blades of an outdoor unit which can protect the outdoor unit by instructing an operation suitable for the louver blades according to a power state of an indoor unit.

Yet another object of the present invention is to provide an apparatus and method for controlling louver blades of an outdoor unit which can control an open angle of the louver blades according to external humidity of the outdoor unit.

Yet another object of the present invention is to provide an apparatus and method for controlling louver blades of an outdoor unit which can optimize an open angle of the louver blades in order to minimize inflow of alien substances such as rain drops and snow and decrease a fan resistance.

In order to achieve the above-described objects of the invention, there is provided an apparatus for controlling louver blades of an outdoor unit, including: a louver blade member including louver blades having a pair of connecting protrusions at their both ends, and first to fourth levers for rotatably connecting the connecting protrusions of the louver blades formed in the same positions; a driving member for opening/closing the louver blades by moving the first to fourth levers in the vertical direction to the louver blades by a predetermined distance; and a microcomputer for controlling the driving member, and opening/closing the louver blades by generating a control command.

Here, the first to fourth levers include a plurality of openings so that the connecting protrusions of the louver blades can pass through the openings, and the louver blade member further includes rotation links for connecting the connecting protrusions of the identical louver blades passing through the openings of the first to fourth levers.

Preferably, the driving member is connected to at least one of the rotation links, for moving the two levers connected to one end of the louver blade in different directions by a predetermined distance.

The driving member includes a driving source for performing a rectilinear motion in parallel to the first to fourth levers, and a connector connected to one rotation link, for transforming the rectilinear motion of the driving source into a rotary motion of the rotation link.

Preferably, the apparatus further includes a first sensor for generating a first contact point signal and transmitting the signal to the microcomputer, when the louver blades are closed.

The microcomputer receives the first contact point signal from the first sensor, calculates a period of the signal, compares the period with a non-use reference time of the louver blades, generates an idling control command of the louver blades, and transmits the command to the driving member.

Preferably, the first sensor is positioned to contact with one side of at least one of the first to fourth levers.

Preferably, one of the rotation links includes a long protrusion unit, and the first sensor is positioned to contact with the protrusion unit.

Preferably, the apparatus further includes a second sensor for generating a second contact point signal and transmitting the signal to the microcomputer, when the louver blades are opened.

Preferably, the first sensor is positioned to contact with one side of at least one of the first to fourth levers, and the second sensor is positioned to contact with the other side of the lever.

Preferably, one of the rotation links includes a long protrusion unit, and the first and second sensors are positioned to contact with the protrusion unit by the open/close operation of the louver blades.

In addition, the microcomputer is connected to an indoor unit, and decides an open/close state of the louver blades when receiving an operation signal from the indoor unit.

The microcomputer decides the open/close state of the louver blades according to reception of the first contact point signal.

Preferably, the microcomputer operates the driving member to open the louver blades according to the open/close state of the louver blades.

The microcomputer confirms whether the second contact point signal is inputted within a standard re-contact point time after turning off the first sensor, and decides whether the louver blades are normally opened.

Preferably, the microcomputer notifies the operation state of the louver blades to the indoor unit according to the decision result.

Preferably, the first and second sensors are limit switches.

Preferably, the microcomputer is connected to the indoor unit, for generating a close control command of the louver blades, and transmitting the command to the driving member according to a power state of the indoor unit.

Preferably, the apparatus further includes a current transformer controlled by the microcomputer, for sensing generation of an overload current in the driving member, and generating an overload current generation signal, and the microcomputer generates an open control command of the louver blades and transmits the command to the driving member according to reception of the overload current generation signal from the current transformer, when receiving the operation signal from the indoor unit.

Preferably, the microcomputer completely opens the louver blades by the driving member, generates an overload current generation message, transmits the message to the indoor unit, and normally operates the outdoor unit.

Preferably, the driving member further includes a sensor relating to the operation of the louver blades, and the microcomputer controls the sensor, generates an open control command of the louver blades, and transmits the command to the driving member according to a mis-operation state of the sensor, when receiving the operation signal from the indoor unit.

Preferably, the microcomputer completely opens the louver blades by the driving member, generates a mis-operation message of the sensor, transmits the message to the indoor unit, and normally operates the outdoor unit.

Preferably, the apparatus further includes a humidity sensor for sensing current external humidity of the outdoor unit.

Preferably, the microcomputer stores reference humidity, compares the current humidity from the humidity sensor with the stored reference humidity, controls the driving member according to the comparison result, opens the louver blades within a critical angle range, and closes the louver blades.

Preferably, the microcomputer opens the louver blades at the critical angle when the current humidity is equal to or lower than the reference humidity, and opens the louver blades at an angle smaller than the critical angle when the current humidity is higher than the reference humidity.

Preferably, the reference humidity is previously set according to a season.

Preferably, the microcomputer compares the current humidity with the reference humidity after receiving the operation signal from the indoor unit, and completely closes the louver blades before receiving the operation signal from the indoor unit.

According to another aspect of the invention, an apparatus for controlling louver blades of an outdoor unit includes: a driving member for opening/closing a plurality of louver blades; a first sensor for generating a first contact point signal when the louver blades are closed; and a microcomputer for controlling the driving member, and deciding an open/close state of the louver blades according to reception of the first contact point signal from the first sensor.

The microcomputer receives the first contact point signal from the first sensor, calculates a period of the signal, compares the period with a non-use reference time of the louver blades, generates an idling control command of the louver blades, and transmits the command to the driving member.

Preferably, the apparatus further includes a second sensor for generating a second contact point signal, when the louver blades are opened.

Preferably, the microcomputer receives the first contact point signal and/or the second contact point signal from the first and/or second sensors, and decides the open/close state of the louver blades.

In addition, the microcomputer is connected to an indoor unit, and decides the open/close state of the louver blades when receiving an operation signal from the indoor unit.

Preferably, the microcomputer operates the driving member to open the louver blades according to the open/close state of the louver blades.

The microcomputer confirms whether the second contact point signal is inputted within a standard re-contact point time after turning off the first sensor, and decides whether the louver blades are normally opened.

Preferably, the microcomputer notifies the operation state of the louver blades to the indoor unit according to the decision result.

Preferably, the first and second sensors are limit switches.

Preferably, the apparatus further includes a humidity sensor for sensing current external humidity of the outdoor unit.

Preferably, the microcomputer stores reference humidity, compares the current humidity from the humidity sensor with the stored reference humidity, controls the driving member according to the comparison result, opens the louver blades within a critical angle range, and closes the louver blades.

Preferably, the microcomputer opens the louver blades at the critical angle when the current humidity is equal to or lower than the reference humidity, and opens the louver blades at an angle smaller than the critical angle when the current humidity is higher than the reference humidity.

Preferably, the reference humidity is previously set according to a season.

Preferably, the microcomputer compares the current humidity with the reference humidity after receiving the operation signal from the indoor unit, and completely closes the louver blades before receiving the operation signal from the indoor unit.

According to another aspect of the invention, an apparatus for controlling louver blades of an outdoor unit includes: a louver blade member including a plurality of louver blades; a driving member for opening/closing the louver blades by operating the louver blade member; first and second sensors for respectively generating a first contact point signal when the louver blades are closed, and a second contact point sensor when the louver blades are opened; and a microcomputer for controlling the driving member, and deciding an open/close state of the louver blades by receiving the first contact point signal and/or the second contact point signal from the first and/or second sensors.

Here, the microcomputer is connected to an indoor unit, and decides the open/close state of the louver blades when receiving an operation signal from the indoor unit.

The microcomputer decides the open/close state of the louver blades according to reception of the first contact point signal.

Preferably, the microcomputer operates the driving member to open the louver blades according to the open/close state of the louver blades.

Preferably, the microcomputer confirms whether the second contact point signal is inputted within a standard re-contact point time after turning off the first sensor, and decides whether the louver blades are normally opened.

Preferably, the microcomputer notifies the operation state of the louver blades to the indoor unit according to the decision result.

Preferably, the first and second sensors are limit switches.

According to another aspect of the invention, an apparatus for controlling louver blades of an outdoor unit includes: a driving member for opening/closing the louver blades of the outdoor unit; and a microcomputer for controlling the driving member, generating a close operation command of the louver blades, and transmitting the operation command to the driving member according to a power state of an indoor unit.

Preferably, the apparatus further includes a current transformer controlled by the microcomputer, for sensing generation of an overload current in the driving member, and generating an overload current generation signal, and the microcomputer generates an open operation command of the louver blades and transmits the operation command to the driving member according to reception of the overload current generation signal from the current transformer, when receiving the operation signal from the indoor unit.

Preferably, the microcomputer completely opens the louver blades by the driving member, generates an overload current generation message, transmits the message to the indoor unit, and normally operates the outdoor unit.

Preferably, the driving member further includes a sensor relating to the operation of the louver blades, and the microcomputer controls the sensor, generates an open operation command of the louver blades, and transmits the operation command to the driving member according to a mis-operation state of the sensor, when receiving the operation signal from the indoor unit.

Preferably, the microcomputer completely opens the louver blades by the driving member, generates a mis-operation message of the sensor, transmits the message to the indoor unit, and normally operates the outdoor unit.

Preferably, the operation command completely opens the louver blades.

According to another aspect of the invention, an apparatus for controlling louver blades of an outdoor unit includes: a driving member for opening/closing the louver blades of the outdoor unit within a critical angle range; a humidity sensor for sensing current external humidity of the outdoor unit; and a microcomputer for storing reference humidity, comparing the current humidity from the humidity sensor with the stored reference humidity, controlling the driving member according to the comparison result, opening the louver blades within the critical angle range, and closing the louver blades.

Preferably, the microcomputer opens the louver blades at the critical angle when the current humidity is equal to or lower than the reference humidity, and opens the louver blades at an angle smaller than the critical angle when the current humidity is higher than the reference humidity.

Preferably, the reference humidity is previously set according to a season.

Preferably, the microcomputer compares the current humidity with the reference humidity after receiving the operation signal from the indoor unit, and completely closes the louver blades before receiving the operation signal from the indoor unit.

According to another aspect of the invention, in an apparatus for controlling louver blades of an outdoor unit including a plurality of louver blades, and first and second limit switches for generating a first contact point signal when the louver blades are closed, and a second contact point signal when the louver blades are opened, a method for controlling the louver blades of the outdoor unit includes the steps of: receiving the first contact point signal; deciding an open/close state of the louver blades according to reception of the first contact point signal; opening the louver blades according to the decision result; and confirming whether the second contact point signal is inputted within a standard re-contact point time after turning off the first limit switch, and deciding whether the louver blades are normally opened.

Preferably, the step for deciding the open/close state is performed after an operation signal is inputted from an indoor unit.

Preferably, the method further includes a step for transmitting an operation state to the indoor unit after deciding whether the louver blades are normally opened.

According to another aspect of the invention, a method for controlling louver blades of an outdoor unit includes: a first step for deciding a power state of an indoor unit; a second step for closing the louver blades of the outdoor unit according to the decision result of the power state; a third step for deciding an overload current state of a driving member, when an operation signal is inputted from the indoor unit; a fourth step for completely opening the louver blades according to the decision result of the overload current state; a fifth step for deciding a mis-operation state of a sensor relating to the operation of the louver blades, when the operation signal is inputted from the indoor unit or the overload current is not generated in the driving member; and a sixth step for completely opening the louver blades according to the decision result of the mis-operation state.

Preferably, the second step includes a step for completely closing the louver blades when the indoor unit is off.

Preferably, the method further includes the step of: transmitting an overload current generation message of the driving member to the indoor unit; and normally operating the outdoor unit after the fourth step.

Preferably, the method further includes the steps of: transmitting a message relating to a mis-operation of the limit switch to the indoor unit; and normally operating the outdoor unit after the sixth step.

According to another aspect of the invention, a method for controlling louver blades of an outdoor unit includes the steps of: calculating a close period of the louver blades; comparing the close period with a non-use reference time; and idling the louver blades according to the comparison result.

Preferably, the step for calculating the close period includes the step of: storing a close time of the louver blades; and calculating the close period of the louver blades by a difference between the current time and the stored close time.

Preferably, the method further includes a step for updating and storing the close time when the louver blades are opened and closed again.

According to another aspect of the invention, a method for controlling louver blades of an outdoor unit includes the steps of: sensing current external humidity of the outdoor unit; comparing the current humidity with reference humidity; and opening the louver blades within a critical angle range and closing the louver blades according to the comparison result.

Preferably, the control step opens the louver blades at the critical angle when the current humidity is equal to or lower than the reference humidity, and opens the louver blades at an angle smaller than the critical angle when the current humidity is higher than the reference humidity.

Preferably, the method further includes a step for resetting the reference humidity according to a season.

Preferably, the method performs the step for comparing the current humidity with the reference humidity after the operation signal is inputted from the indoor unit.

Preferably, the method further includes a step for completely closing the louver blades before the operation signal is inputted from the indoor unit.

BEST MODE FOR CARRYING OUT THE INVENTION

An apparatus and method for controlling louver blades of an outdoor unit in accordance with the present invention will now be described in detail with reference to the accompanying drawings.

Figure 1:
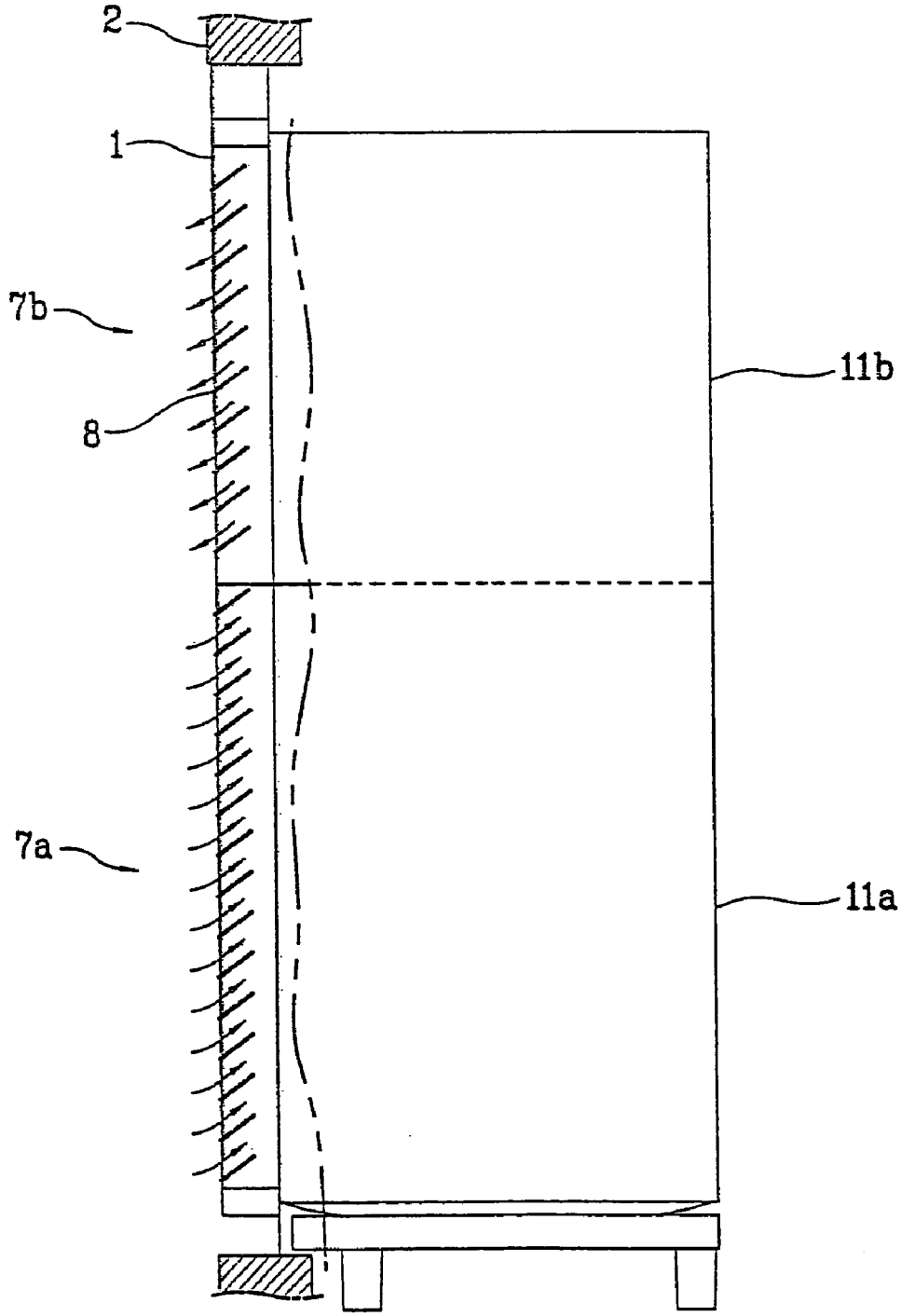
FIG. 1 CONVENTIONAL ART
FIG. 1 is a schematic structure view illustrating a conventional louver unit.
Figure 2:
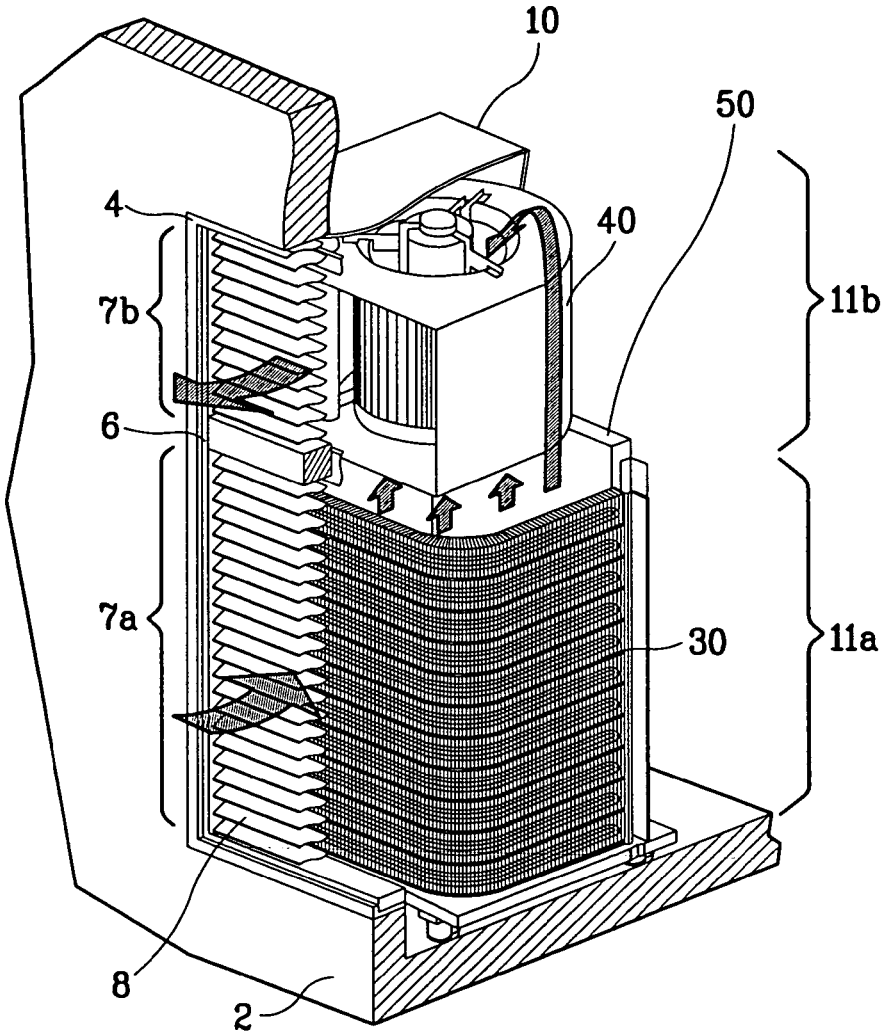
FIG. 2 is a partially-cut perspective-sectional view illustrating a built-in type outdoor unit for an air conditioner to which an apparatus for controlling louver blades of an outdoor unit is applied in accordance with a preferred embodiment of the present invention.
Figure 3:
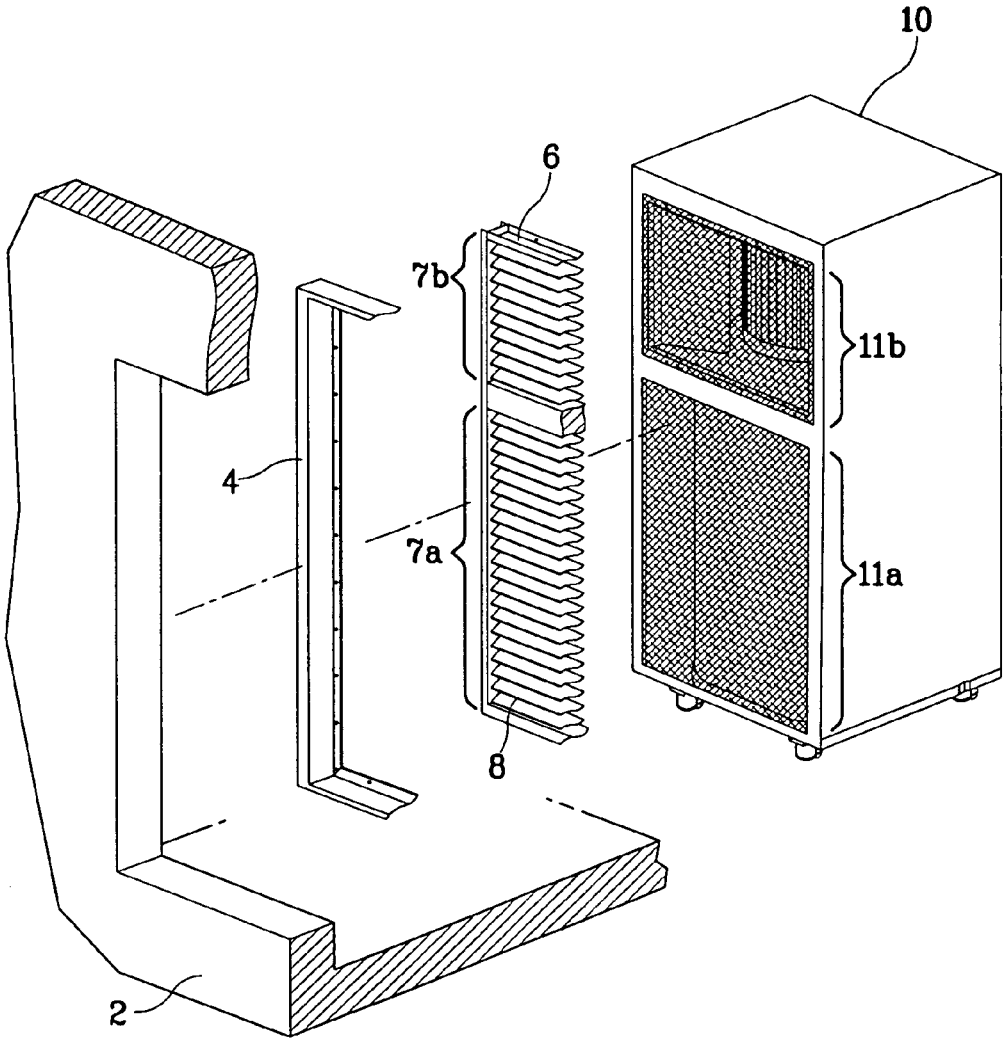
FIG. 3 is an exemplary view illustrating installation and assembly of the outdoor unit of FIG. 2.

FIGS. 2 and 3 are structure views illustrating a built-in type outdoor unit for an air conditioner to which the apparatus and method for controlling the louver blades of the outdoor unit is applied in accordance with the present invention.

As illustrated in FIGS. 2 and 3, an external frame 4 is fixedly installed on a rectangular space inner wall formed on an outer wall 2 of a residential and/or commercial building, and an internal frame 6 is fixedly installed at the inside of the external frame 4. The internal and external frames 4 and 6 can be incorporated. An inside area of the internal frame 6 is divided into a suction area 7*a* and a discharge area 7*b*. A plurality of louver blades 8 are installed in each area, so that air can be sucked or discharged through gaps between the louver blades 8.

The detailed structure of the louver blades 8 will later be explained.

On the other hand, an outdoor unit 10 (partially shown) fixedly installed at the inside of the outer wall 2 of the building to contact with the external frame 4 and/or internal frame 6 includes an outdoor unit casing. The outdoor unit casing opens its one side facing the suction area 7*a* and the discharge area 7*b* of the internal frame 6. The opened side is divided into a suction unit 11*a* and a discharge unit 11*b* to correspond to the suction area 7*a* and the discharge area 7*b* of the internal frame 6.

A compressor (not shown) and a 'U' shaped air-cooled condenser 30 are installed in the outdoor unit suction unit 11*a*. In the air-cooled condenser 30, a plurality of condenser pipe lines are formed in a zigzag shape between a plurality of condenser fins. The structure and shape of the air-cooled condenser 30 have been publicly known, and thus are not shown in detail. A refrigerant gas compressed by the compressor (not shown) is transmitted through the pipe lines of the condenser 30, removed its condensation heat by externally-supplied air, and condensed.

A cooling fan 40 for supplying external air to the air-cooled condenser 30 through the suction area 7*a* and discharging heat exchanged air through the discharge area 7*b* is fixedly installed in the outdoor unit discharge unit 11*b*. A sirocco cooling fan is used as the cooling fan 40.

A control box 50 for controlling the operation of the outdoor unit 10 is installed on the rear surface of the outdoor unit. A microcomputer (not shown) for controlling an open/close operation of the louver blades 8, and processing a signal from a limit switch (not shown) is formed in the control box 50, which will later be explained in detail.

Figure 4A:
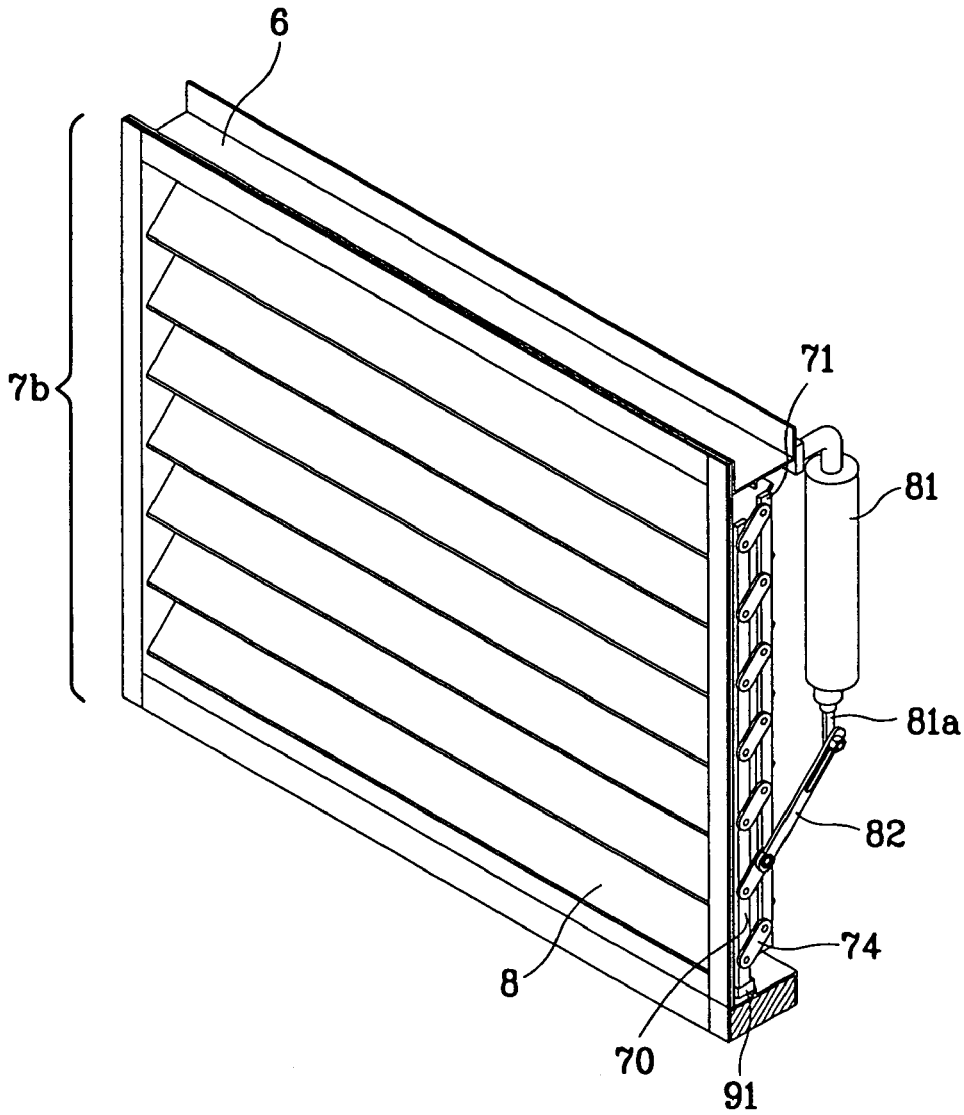
FIGS. 4A and 4B are a perspective view and a partially-disassembled view illustrating a louver blade member to which the apparatus for controlling the louver blades of the outdoor unit is applied in accordance with the present invention.
Figure 4B:
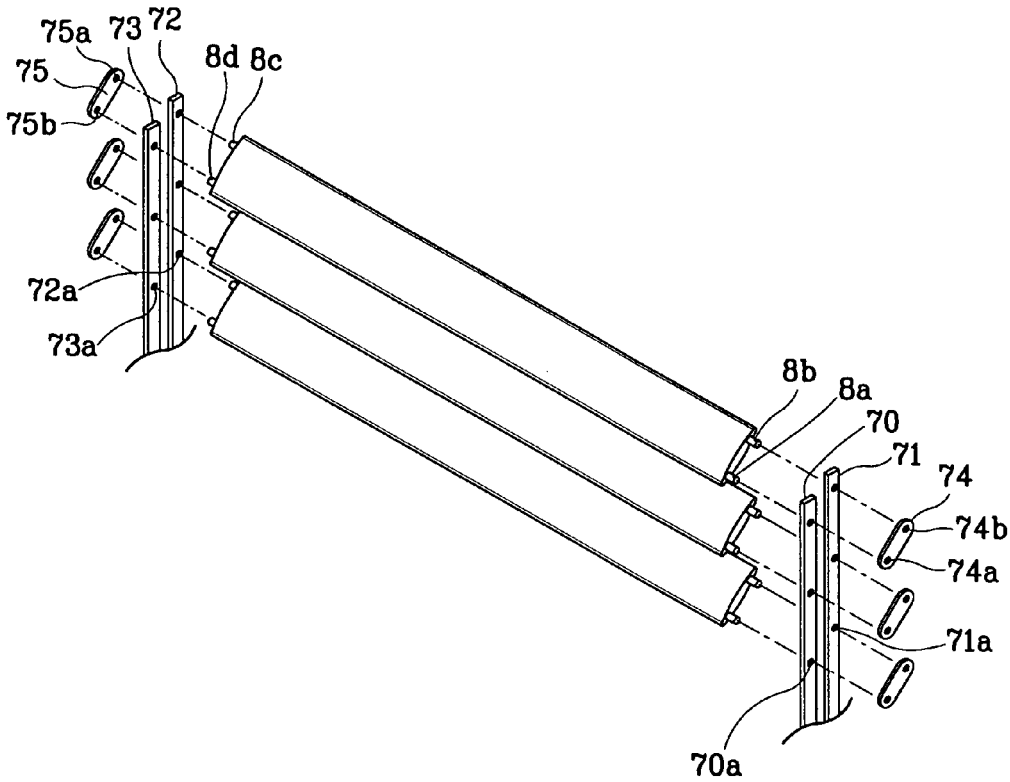

FIGS. 4A and 4B are a perspective view and a partially-disassembled view illustrating a louver blade member to which the apparatus for controlling the louver blades of the outdoor unit is applied in accordance with the present invention. Referring to FIGS. 4A and 4B, the louver blade member of the discharge area 7*b* includes louver blades 8 having a pair of connecting protrusions 8*a*, 8*b*, 8*c* and 8*d* at their both ends, first to fourth levers 70, 71, 72 and 73 having a plurality of openings 70*a*, 71*a*, 72*a* and 73*a* so that the connecting protrusions 8*a*, 8*b*, 8*c* and 8*d* of the louver blades 8 formed in the same positions can pass through the openings 70*a*, 71*a*, 72*a* and 73*a*, and rotation links 74 and 75 for connecting the connecting protrusions 8*a*, 8*b*, 8*c* and 8*d* of the identical louver blades 8 exposed through the first to fourth levers 70, 71, 72 and 73. The louver blade member of the suction area 7*a* has the same constitution as the louver blade member of the discharge area 7*b*. In addition, the louver blade member can be modified to simultaneously operate the louver blades 8 of the suction area 7*a* and the discharge area 7*b*. Such modifications can be easily made by those skilled in the field to which the present invention pertains.

Here, the rotation links 74 and 75 include a pair of openings 74*a*, 74*b*, 75*a* and 75*b* to externally expose the connecting protrusions 8*a*, 8*b*, 8*c* and 8*d*, and may further include a plurality of grooves (not shown) into which the connecting protrusions 8*a*, 8*b*, 8*c* and 8*d* are inserted without being externally exposed.

In addition, a connector 82 which is a motion transforming means for transforming a rectilinear motion of a driving source (not shown) into a rotary motion of the rotation link is connected to one rotation link 74. The connector 82 in which a guide groove 82*a* is formed, a driving source 81 in which a mover 81*a* is formed, and a first limit switch 91 will later be explained.

According to another aspect of the invention, the first to fourth levers 70, 71, 72 and 73 include grooves (not shown) into which the connecting protrusions 8*a*, 8*b*, 8*c* and 8*d* of the louver blades 8 are inserted without passing through the grooves. Here, when a connector (not shown) which is a motion transforming means for transforming a rectilinear motion of the driving source into a rotary motion of the louver blades is connected to the louver blades 8, the louver blade member performs the same operation as the louver blade member of FIG. 4A.

Figure 5A:
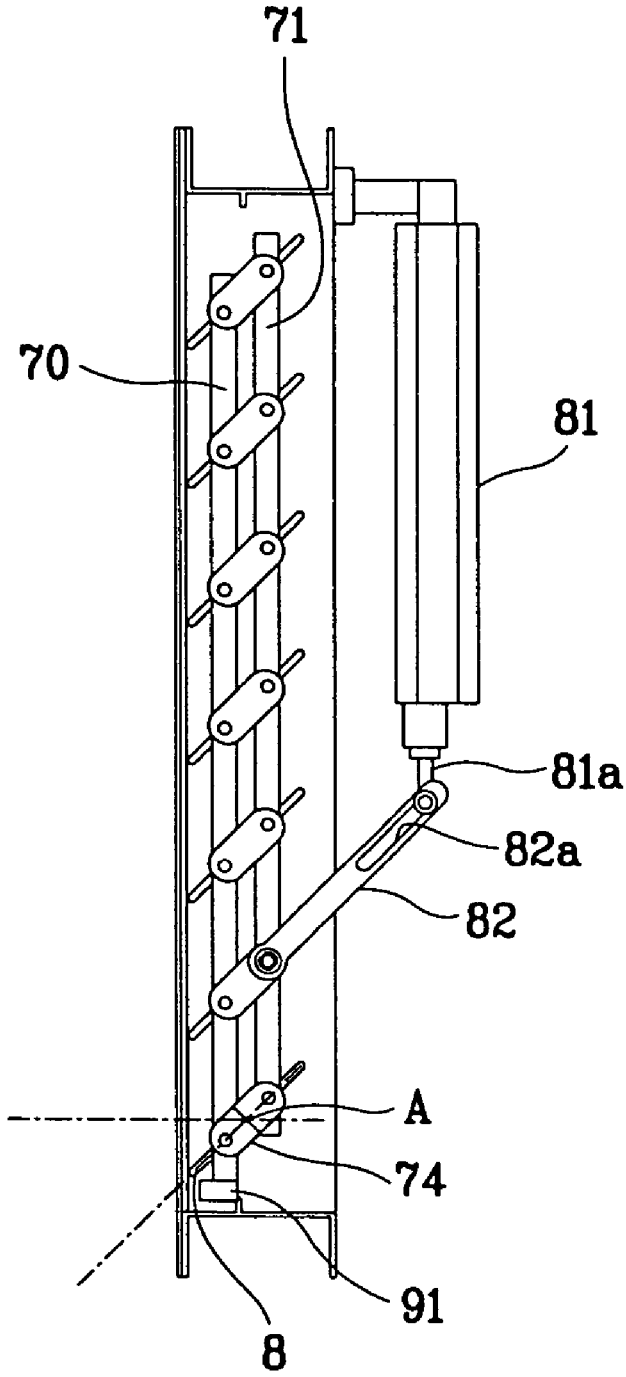
FIGS. 5A and 5B are side views illustrating a louver blade member and a driving member in close and open states to which the apparatus for controlling the louver blades of the outdoor unit is applied in accordance with the present invention.
Figure 5B:
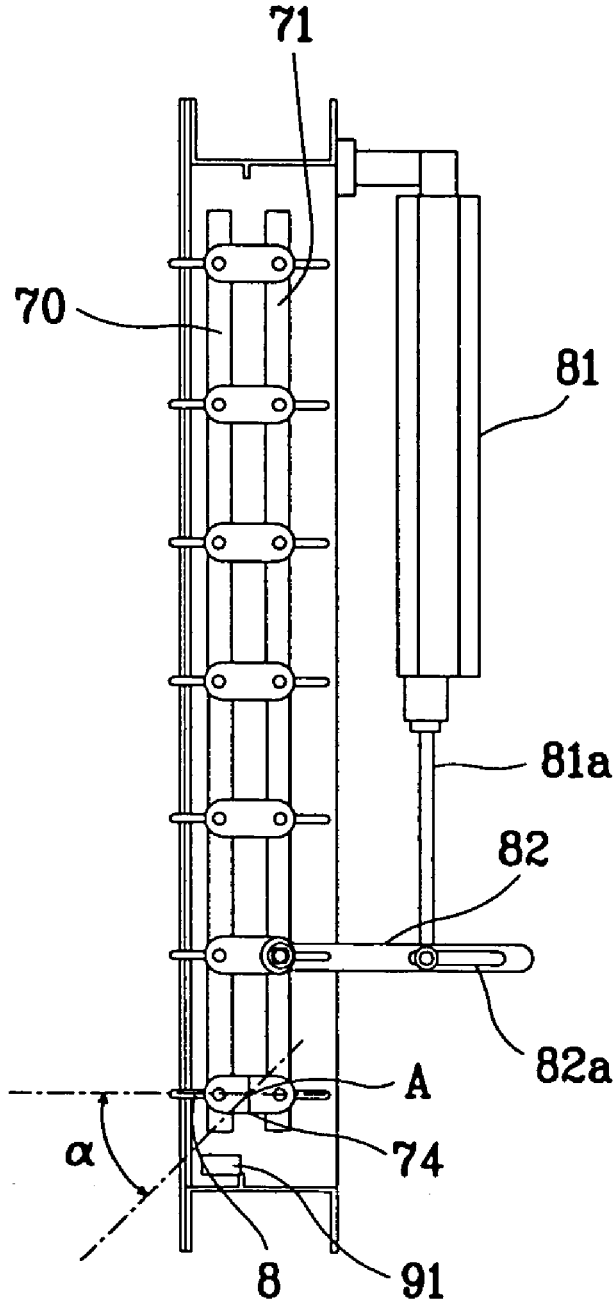

FIGS. 5A and 5B are side views illustrating a louver blade member and a driving member in close and open states to which the apparatus for controlling the louver blades of the outdoor unit is applied in accordance with the present invention.

FIG. 5A shows a connector 78 which is the motion transforming means connected to one rotation link 74 of the louver blade member of FIGS. 4A and 4B, and a driving source 81 for allowing a mover 81*a* to perform a rectilinear motion which movably contacts with (or is connected to) a guide groove 78*a* of the connector 78 to push the connector 82. Hereinafter, the connector 82 and the driving source 81 are referred to as a driving member.

Figure 6:
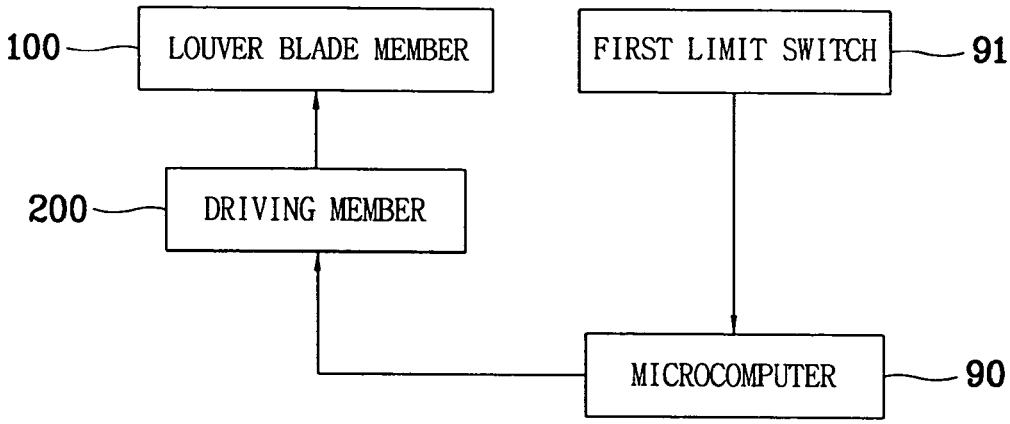
FIG. 6 is a structure view illustrating an apparatus for controlling louver blades of an outdoor unit in accordance with a first embodiment of the present invention.

The operation of the driving source 81 is started and ended under the control of the microcomputer (refer to FIG. 6).

FIG. 5A illustrates a state where the driving source 81 inwardly shrinks the mover 81*a* to close the louver blades 8.

Especially, FIG. 5A shows a first limit switch 91 contacting with one end of one of the first to fourth levers 70, 71, 72 and 73 (for example, first lever 70), generating a contact point signal, and continuously transmitting the signal to the microcomputer.

As illustrated in FIG. 5B, the driving source 81 (for example, driving motor, hydraulic cylinder, etc.) allows the mover 81*a* to perform a rectilinear motion in parallel to the first to fourth levers 70, 71, 72 and 73 under the control of the microcomputer, the mover 81*a* performing the rectilinear motion pushes the connector 78 along the guide groove 78*a*, the connector 78 has its one end connected to the rotation link 74 to perform a rotary motion, and thus the rotation link 74 performs a rotary motion on a point (A) at a certain angle ($\alpha$). The rotary motion of the rotation link 74 results in rotation of another rotation link 75 by the first to fourth levers 70, 71, 72 and 73, and thus the first lever 70 contacting with the first limit switch 91 moves by a predetermined distance (d). The fourth lever 73 moves in the same direction as the first lever 70, and the second and third levers 71 and 72 move in the opposite direction to the first lever 70. Here, the first lever 70 is separated from the first limit switch 91, to intercept transmission of the contact point signal to the microcomputer.

FIG. 6 is a structure view illustrating an apparatus for controlling louver blades of an outdoor unit in accordance with a first embodiment of the present invention. Referring to FIG. 6, the apparatus includes a louver blade member 100 as shown in FIGS. 4A and 4B, a driving member 200 for opening/closing louver blades 8 of the louver blade member 100 under the control of a microcomputer 90, a first limit switch 91 for continuously transmitting a contact point signal when the louver blades 8 are closed, and the microcomputer 90 for controlling the driving member 200, and receiving the contact point signal from the first limit switch 91.

The microcomputer 90 includes a memory (not shown) for storing a non-use reference time of the louver blades 8 automatically set or set by the user before the operation of the outdoor unit 10. Here, the non-use reference time is an allowable time for which the louver blades 8 can remain in a close state. If the louver blades 8 are not operated for a long term, an open/close operation of the louver blades is not efficiently performed due to dust, ice or moisture. Accordingly, the non-use reference time is set to periodically operate the louver blades 8.

Figure 7:
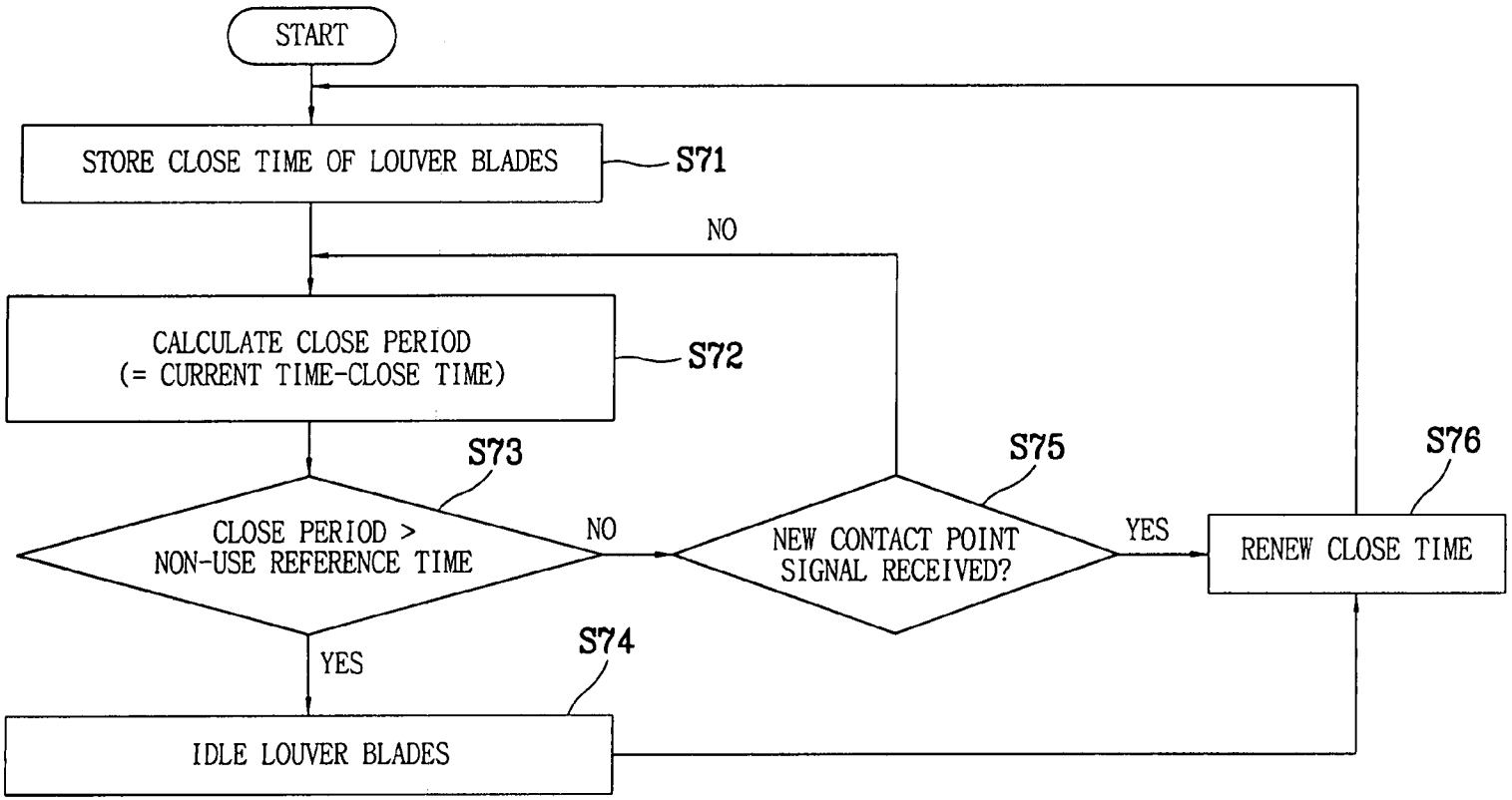
FIG. 7 is a flowchart showing a method for controlling the louver blades of the outdoor unit in accordance with the first embodiment of the present invention.

FIG. 7 is a flowchart showing a method for controlling the louver blades of the outdoor unit in accordance with the first embodiment of the present invention. This method can be performed by the apparatus of FIG. 6 and/or other apparatuses.

The method performs a step S71 for storing a close time of the louver blades 8 by the microcomputer 90, a step S72 for calculating a close period of the louver blades 8 by subtracting the close time from the current time, a step S73 for deciding whether the close period is longer than the non-use reference time, a step S74 for idling the louver blades 8 when the close period is longer than the non-use reference time, a step S75 for deciding whether a new contact point signal is inputted when the close period is equal to or shorter than the non-use reference time, the step S72 when a new contact point signal is not inputted, a step S76 for updating the close time according to a new contact point signal when the contact point signal is inputted or idling of the louver blades 8 is finished in S74, and the step S71 for re-storing the updated close time.

In more detail, in S71, when the louver blades 8 are closed, the louver blades 8 contact with the first limit switch 91, and the first limit switch 91 generates a contact point signal and transmits the signal to the microcomputer 90. Here, the microcomputer 90 stores a contact point arrival time in the memory as the close time.

In S72, the microcomputer 90 calculates the close period of the louver blades 8 by subtracting the close time stored in the memory from the current time.

In S73, the microcomputer 90 compares the close period calculated in S72 with the non-use reference time stored in the memory. When the close period is longer than the non-use reference time, namely when the allowable non-use time of the louver blades 8 elapses, the routine goes to step S74. When the close period is equal to or shorter than the non-use reference time, the routine goes to S75.

In S74, the microcomputer 90 transmits an idling command for repeatedly opening and closing the louver blades 8 in a certain number to the driving member 200. The driving member 200 receiving the idling command opens and closes the louver blades 8 of the louver blade member 100. The routine goes to S76.

In S75, the microcomputer 90 decides whether a new contact point signal is inputted from the first limit switch 91, namely whether the louver blades 8 are opened and closed. When the new contact point signal is not inputted, the routine goes to S72, and when the new contact point signal is inputted, the routine goes to S76.

When the routine goes to S76 from S74, the louver blades 8 are repeatedly opened and closed a few times, and finally closed, and thus the microcomputer 90 must update the close time stored in the memory. When the routine goes to S76 from S75, the microcomputer 90 receiving the new contact point signal must update the close time. When the close time has been updated, the routine goes back to S71. Here, the microcomputer 90 stores the updated contact point signal in the memory. Thereafter, the procedure is repeated.

Figure 8:
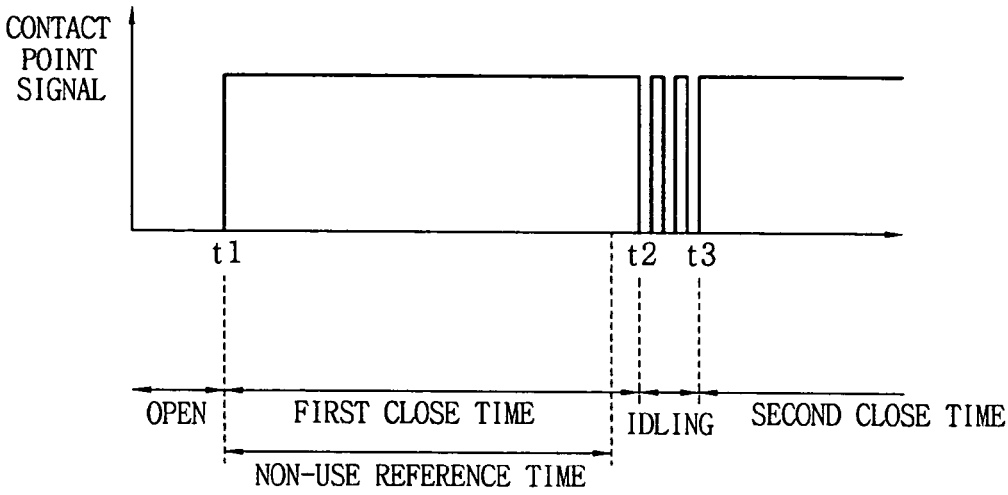
FIG. 8 is a graph showing a calculated close period of FIG. 7.

FIG. 8 is a graph showing the calculated close period of FIG. 7. As shown in FIG. 8, while the microcomputer 90 does not receive the contact point signal, the louver blades 8 remain in an open state. The microcomputer 90 continuously receives the contact point signal for a first close time period t1~t2. When the current time is t2, the first close time is longer than the non-use reference time, and thus the microcomputer 90 idles the louver blades 8 for an idling period t2~t3. Because a time t3 of finishing the idling operation is a time of receiving a new contact point signal, a second close time starts.

Figure 9A:
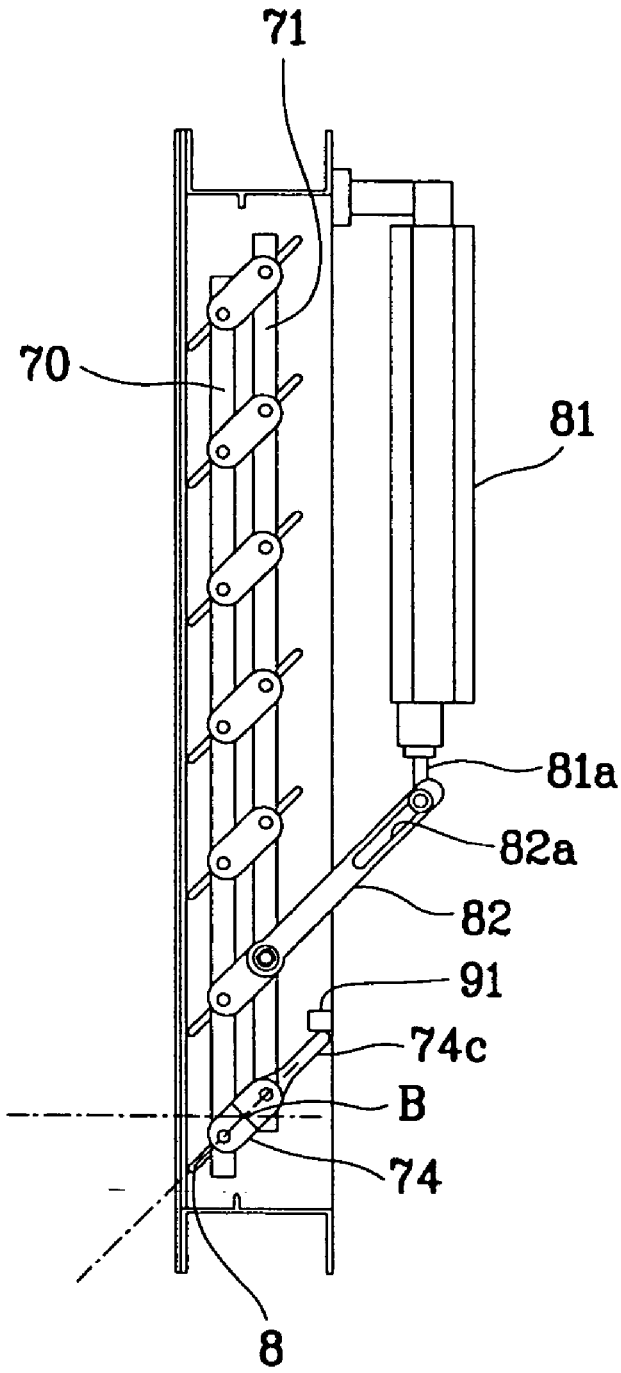
FIGS. 9A and 9B are side views illustrating different operations of a first limit switch in close and open states of the apparatus for controlling the louver blades of the outdoor unit in accordance with the present invention.
Figure 9B:
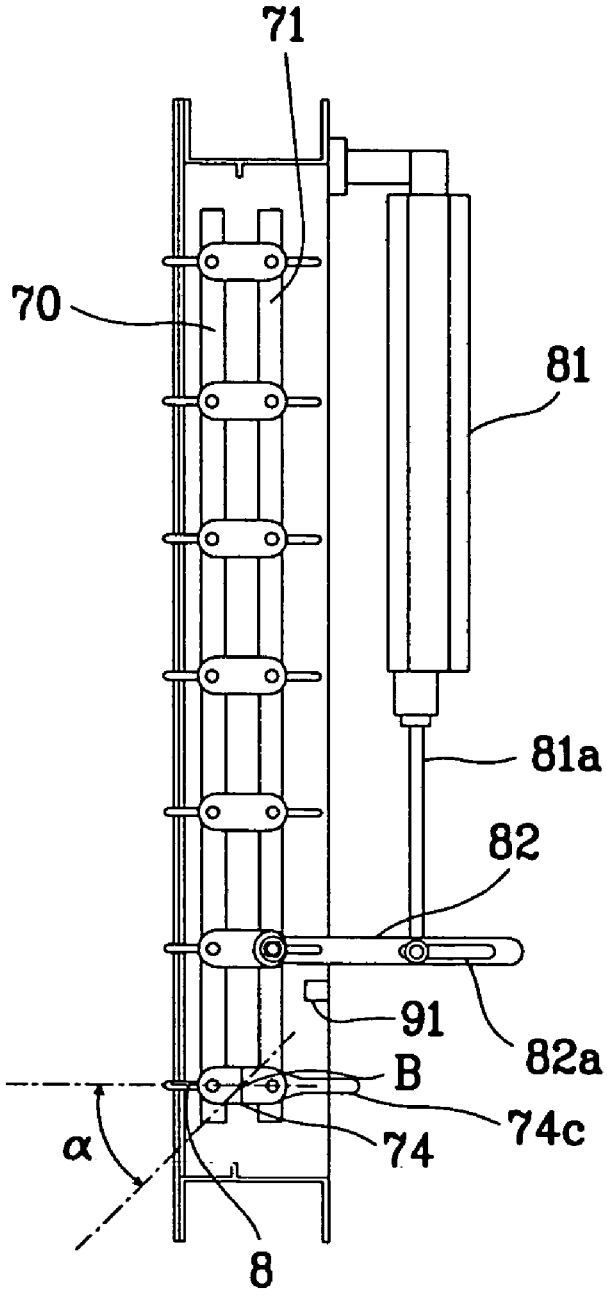

FIGS. 9A and 9B are side views illustrating different operations of the first limit switch in close and open states of the apparatus for controlling the louver blades of the outdoor unit in accordance with the present invention. The apparatus of FIG. 9A includes the louver blade member of FIG. 5A, and further includes a protrusion unit 74*c* formed at one end of one rotation link 74, and a first limit switch 91 contacted by the protrusion unit 74*c*.

The protrusion unit 74*c* contacts with the first limit switch 91, and generates a first contact point signal. The first contact point signal is transmitted to the microcomputer 90 to notify that the louver blades 8 are closed.

When the driving member 200 is operated by the microcomputer 90 in FIG. 9B, the rotation link 74 is rotated on a point (B) at a certain angle (α), and thus the protrusion unit 74*c* is separated from the first limit switch 91, to intercept the first contact point signal. Accordingly, the microcomputer 90 is informed that the louver blades 8 are not closed (or opened or being opened).

The apparatus of FIGS. 9A and 9B performs the same operation as the apparatus of FIGS. 5A and 5B according to the method of FIG. 8.

Figure 10A:
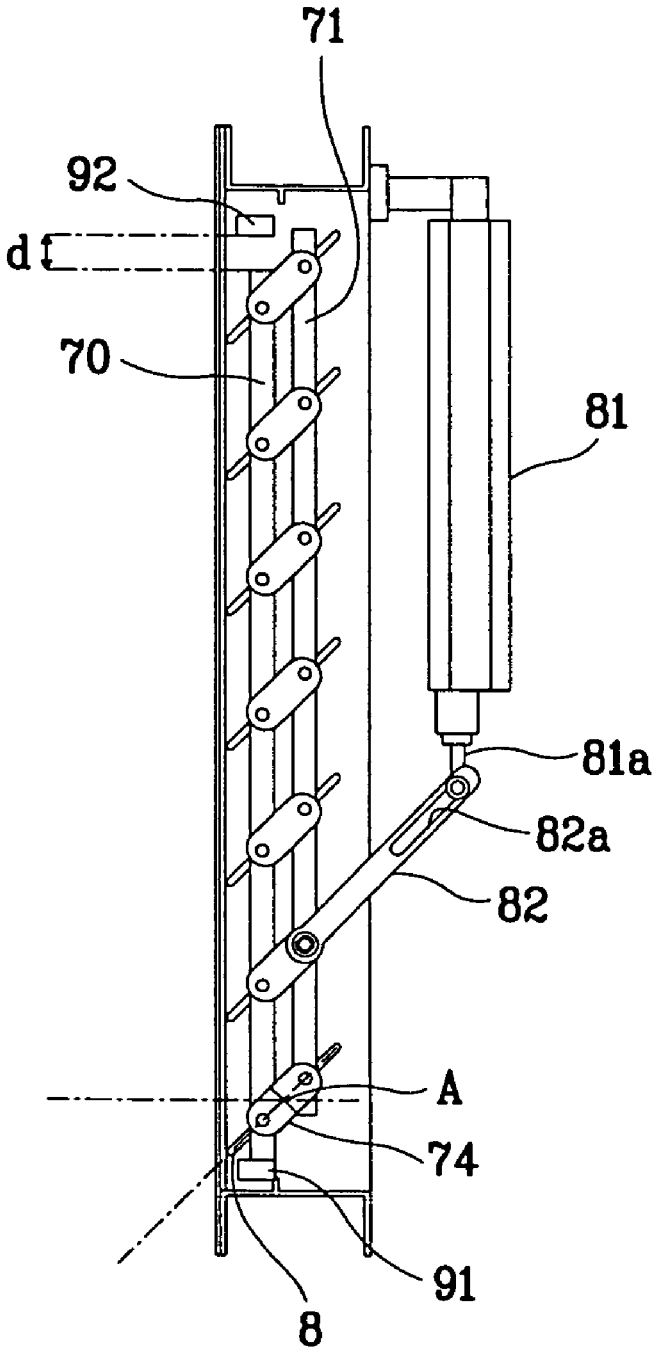
FIGS. 10A and 10B are side views illustrating a louver blade member and a driving member in close and open states on which an apparatus for controlling louver blades of an outdoor unit is mounted in accordance with a second embodiment of the present invention.
Figure 10B:
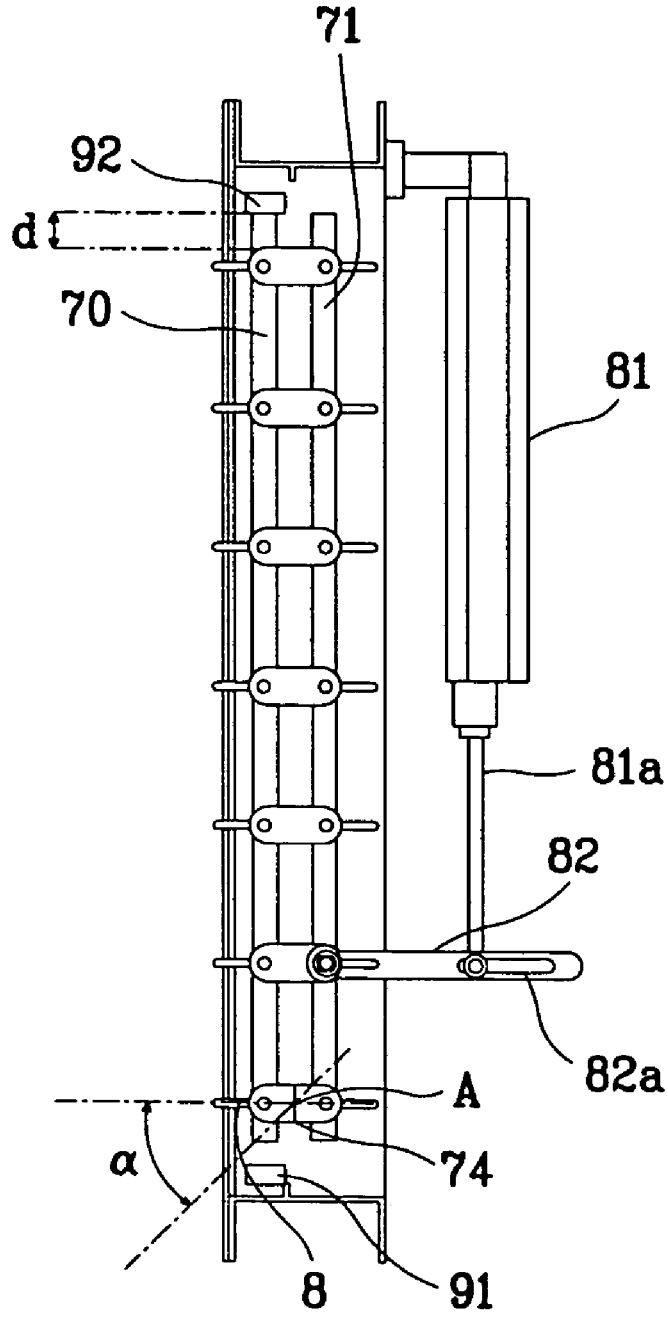

FIGS. 10A and 10B are side views illustrating a louver blade member and a driving member in close and open states in accordance with a second embodiment of the present invention.

FIG. 10A shows a first limit switch 91 contacting with one end of one of first to fourth levers 70, 71, 72 and 73 (for example, first lever 70), generating a first contact point signal, and continuously transmitting the signal to a microcomputer, and a second limit switch 92 contacting with the other end of the first lever 70, generating a second contact point signal, and continuously transmitting the signal to the microcomputer. The detailed operation will be explained in FIG. 11.

Referring to FIG. 10B, a driving source 81 (for example, driving motor, hydraulic cylinder, etc.) allows a mover 81*a* to perform a rectilinear motion in parallel to the first to fourth levers 70, 71, 72 and 73 under the control of the microcomputer, the mover 81*a* performing the rectilinear motion pushes a connector 82 along a guide groove 82*a*, and the connector 82 having its one end connected to a rotation link 74 performs a rotary motion. That is, the rotation link 74 performs the rotary motion on a point (A) at a certain angle (α). The rotary motion of the rotation link 74 results in rotation of another rotation link 75 by the first to fourth levers 70, 71, 72 and 73, and thus the first lever 70 contacting with the first limit switch 91 moves by a predetermined distance (d) until it reaches the second limit switch 92. Here, the fourth lever 73 moves in the same direction as the first lever 70, and the second and third levers 71 and 72 move in the opposite direction to the first lever 71.

In addition, the first lever 70 contacts with the second limit switch 92, and transmits the second contact point signal to the microcomputer.

Figure 11:
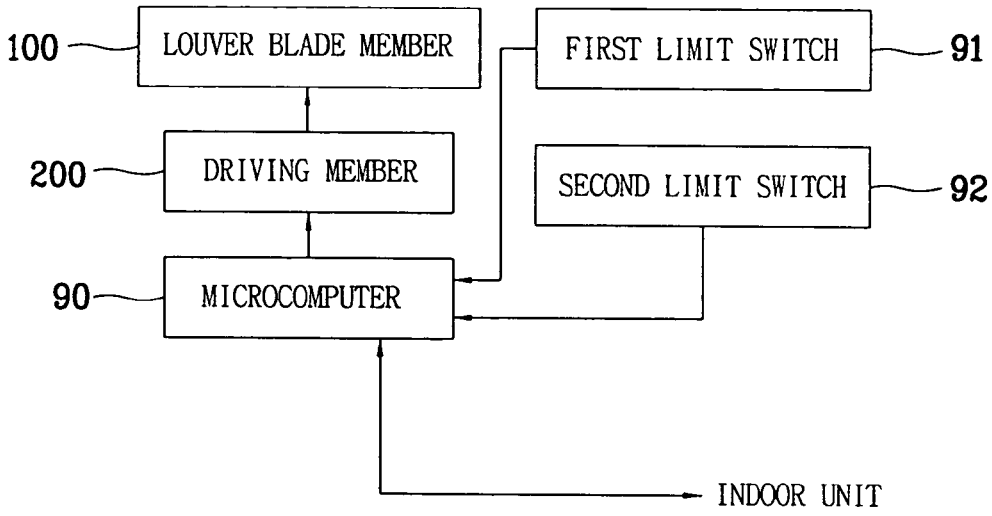
FIG. 11 is a structure view illustrating an apparatus for controlling the louver blades of the outdoor unit in accordance with the second embodiment of the present invention.

FIG. 11 is a structure view illustrating an apparatus for controlling louver blades of an outdoor unit in accordance with a second embodiment of the present invention. As illustrated in FIG. 11, a microcomputer 90 controls a driving member 200 to allow a louver blade member 100 to perform an open/close operation of the louver blades, and respectively receives first and second contact point signals from first and second limit switches 91 and 92. In addition, the microcomputer 90 is connected to perform bidirectional communication with a control apparatus of an indoor unit, for receiving a control command from the control apparatus, and notifying an operation state of the outdoor unit to the control apparatus.

Figure 12:
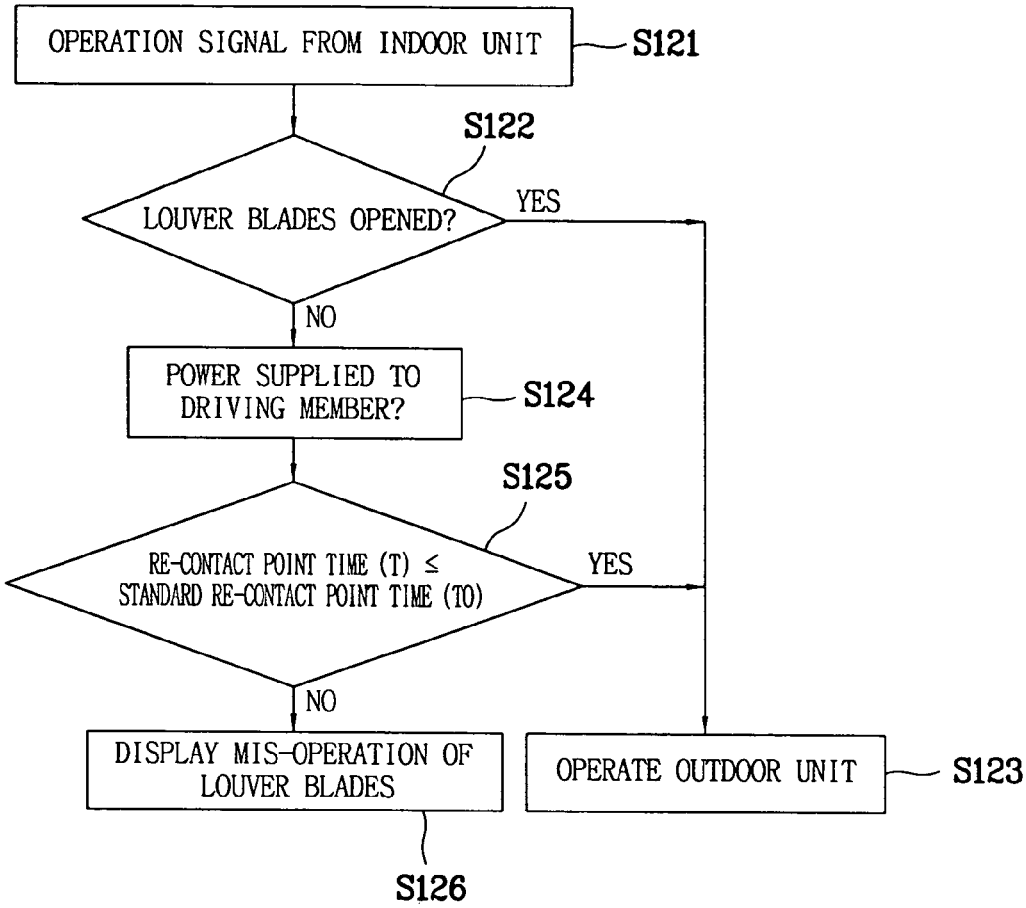
FIG. 12 is a flowchart showing a method for controlling the louver blades of the outdoor unit in accordance with the second embodiment of the present invention.

FIG. 12 is a flowchart showing a method for controlling the louver blades of the outdoor unit in accordance with the second embodiment of the present invention. The method of FIG. 12 is performed by the apparatus of FIG. 11 and/or other apparatuses.

The method performs a step S121 for inputting an operation signal (notifying that the indoor unit is on to start the operation) from the indoor unit to the microcomputer 90, a step S122 for deciding whether the louver blades 8 are opened, a step S123 for operating the outdoor unit 10 when the louver blades 8 are opened, a step S124 for applying power (and/or open command of louver blades) to the driving member 200 when the louver blades 8 are not opened, a step S125 for comparing a re-contact point time (T) with a standard re-contact point time (TO), the step S123 when the re-contact point time (T) is equal to or shorter than the standard re-contact point time (TO), and a step S126 for transmitting an operation error message of the louver blades 8 to the control apparatus of the indoor unit when the re-contact point time (T) is longer than the standard re-contact point time (TO).

In detail, in S121, when the microcomputer 90 receives the operation signal from the control apparatus of the indoor unit, the microcomputer 90 supplies power to the first and second limit switches 91 and 92.

In S122, the microcomputer 90 respectively receives the first and second contact point signals from the first and second limit switches 91 and 92. Here, when the microcomputer 90 receives the first contact point signal, the microcomputer 90 decides that the louver blades 8 are closed, and goes to S124, and when the microcomputer 90 receives the second contact point signal, the microcomputer 90 goes to S123.

In S123, the microcomputer 90 initiates the operation of the other components, such as a compressor and a cooling fan, to start the operation of the outdoor unit 10.

In S124, the microcomputer 90 supplies power to the driving member 200, the driving member 200 performs the open operation of the louver blades 8, and the first lever 70 connected to the louver blades 8 releases the first limit switch 91 and contacts with the second limit switch 92. The second contact point signal is generated and transmitted to the microcomputer 90. Here, power supplied to the driving member 200 can be inverse power according to a state and kind of driving source of the driving member 200.

In S125, the microcomputer 90 calculates the re-contact point time (T) which is an interval between an off time of the first limit switch (namely final arrival time of the first contact point signal) and an arrival time of the second contact point signal. Here, the microcomputer 90 previously stores the standard re-contact point time (TO) (critical allowable time or maximum allowable time taken to transform the close state of the louver blades into the open state). When the microcomputer 90 does not receive the second contact point signal within the standard re-contact point time (TO) after turning off the first limit switch 91 (namely when the re-contact point time (T) is longer than the standard re-contact point time (TO)), the microcomputer 90 decides that a mis-operation is generated during the open operation of the louver blades 8, and goes to S126. The procedure is performed when the second contact point signal is inputted after the standard re-contact point time (TO) from the off time of the first limit switch 91, and when the second contact point signal is not inputted (namely when the second limit switch is not on). The mis-operation implies problems relating to the open/close operation of the louver blades 8. For example, it may take a long time to open the louver blades 8 due to accumulated alien substances of the louver blades 8, or the louver blades 8 may not be opened due to the same reasons.

Conversely, when the microcomputer 90 receives the second contact point signal within the standard re-contact point time (TO) from the off time of the first limit switch 91 (namely, when the re-contact point time (T) is equal to or shorter than the standard re-contact point time (TO)), the microcomputer 90 decides that the louver blades 8 are normally opened, and goes to S123.

In S126, the microcomputer 90 transmits the operation state of the louver blades 8 (namely, operation error message) to the control apparatus of the indoor unit to notify that the mis-operation is generated during the open operation of the louver blades 8, and thus informs the user of the operation state of the louver blades 8.

Figure 13:
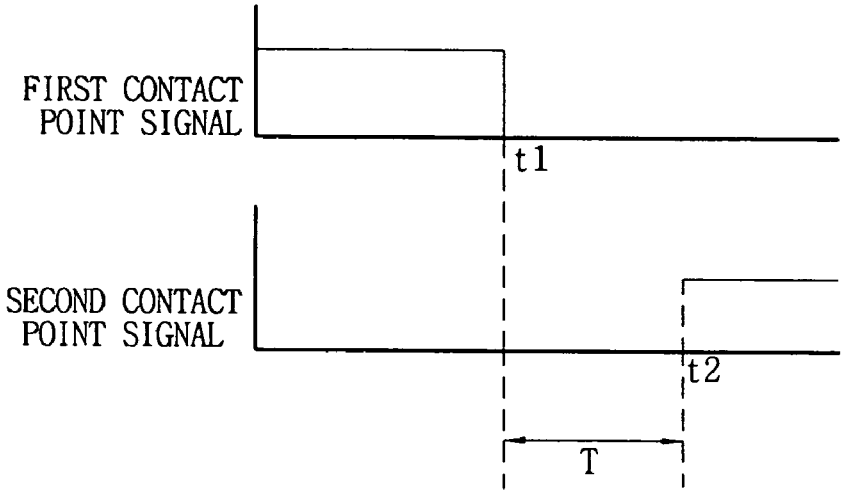
FIG. 13 is an exemplary graph for calculating a re-contact point time (T) of FIG. 12.

FIG. 13 is an exemplary graph for calculating the re-contact point time (T) of FIG. 12. As depicted in FIG. 13, the re-contact point time (T) is an interval between an off time (t1) of the first limit switch 91 which has continuously generated the first contact point signal and transmitted the signal to the microcomputer 90 (namely, the first contact point signal is not inputted) and an on time (t2) of the second limit switch 92 (namely, the second contact point signal is generated and inputted).

Figure 14:
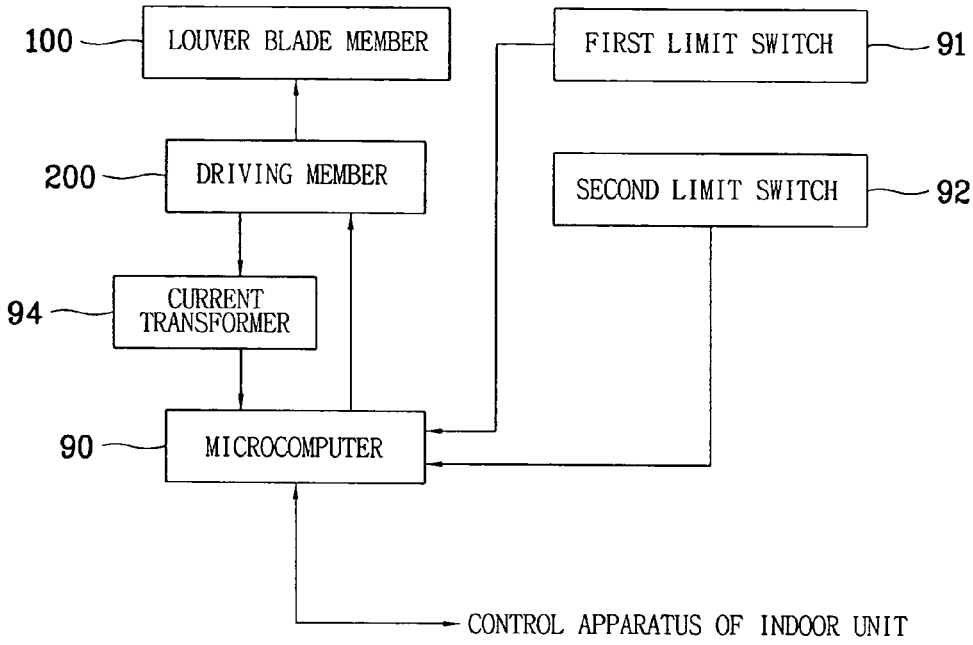
FIG. 14 is a structure view illustrating an apparatus for controlling louver blades of an outdoor unit in accordance with a third embodiment of the present invention.

FIG. 14 is a structure view illustrating an apparatus for controlling louver blades of an outdoor unit in accordance with a third embodiment of the present invention. As depicted in FIG. 14, the apparatus includes a louver blade member 100, a driving member 200 for opening/closing the louver blades 8 of the louver blade member 100 under the control of a microcomputer 90, first and second limit switches 91 and 92 for continuously transmitting first and second contact point signals to the microcomputer 90 when the louver blades 8 are closed and opened, and the microcomputer 90 for controlling the driving member 200, and receiving the contact point signals from the first and second limit switches 91 and 92. In addition, the apparatus includes a current transformer 94 connected to the driving member 200, for deciding whether an overload current is generated in a driving source 81 of the driving member 200, generating an overload current generation signal, and transmitting the signal to the microcomputer 90. The microcomputer 90 is connected to perform bidirectional communication with a control apparatus of an indoor unit.

The microcomputer 90 is also connected with sensors (not shown) relating to the operation of the louver blades including the first and second limit switches 91 and 92, for handling mis-operations of each sensor in the same manner as the mis-operations of the first and second limit switches 91 and 92.

Figure 15:
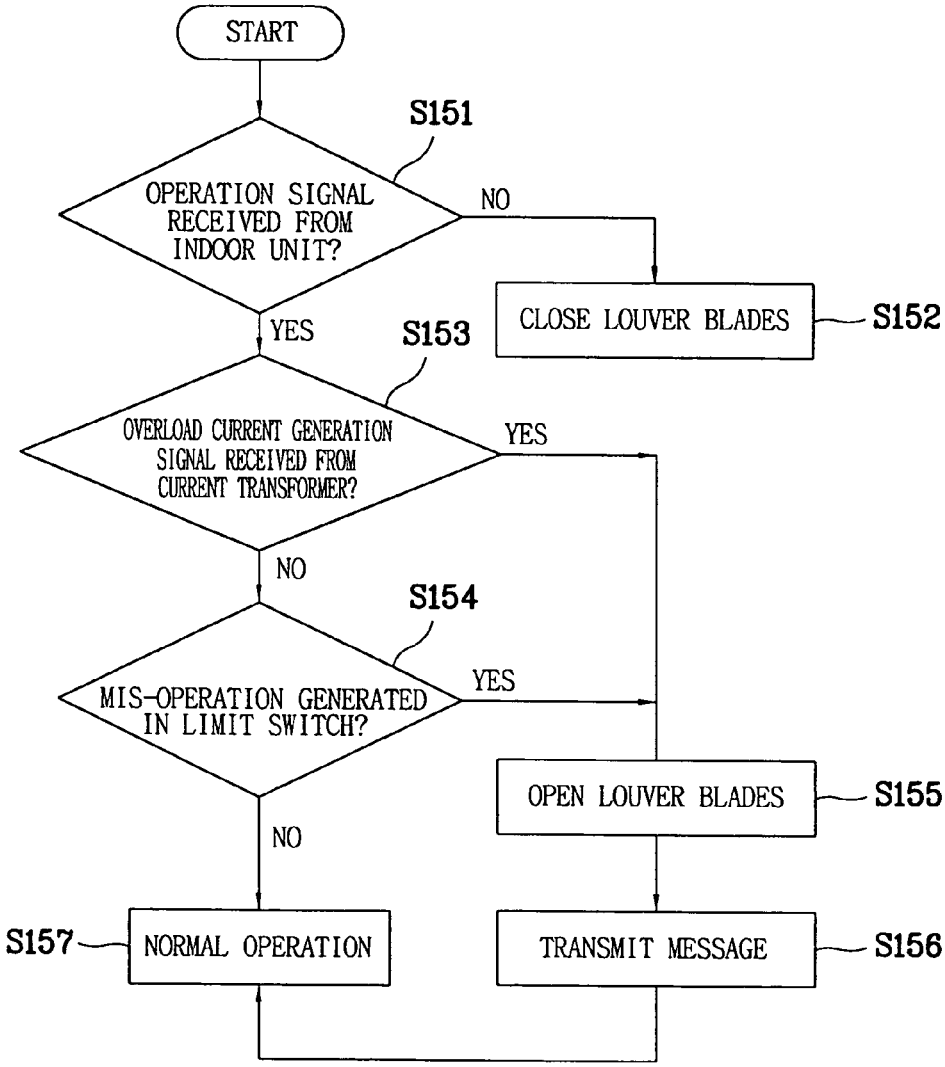
FIG. 15 is a flowchart showing a method for controlling the louver blades of the outdoor unit in accordance with the third embodiment of the present invention.

FIG. 15 is a flowchart showing a method for controlling the louver blades of the outdoor unit in accordance with the third embodiment of the present invention. The method of FIG. 15 is performed by the apparatus of FIG. 14, or other apparatuses.

The method performs a step S151 for deciding whether an operation signal is inputted from the indoor unit, a step S152 for closing the louver blades 8 when the operation signal is not inputted, a step S153 for deciding whether the overload current generation signal is inputted from the current transformer 94 when the operation signal is inputted, a step S154 for deciding whether a mis-operation is generated in the first and/or second limit switches 91 and 92 when the overload current generation signal is not inputted, a step S155 for opening the louver blades 8 when the overload current generation signal is inputted or when the mis-operation is generated in the first and/or second limit switches 91 and 92, a step S156 for receiving the overload current generation signal from the current transformer 94, or transmitting a mis-operation message of the first and/or second limit switches 91 and 92 to the indoor unit, and a step S157 for normally operating the outdoor unit when the mis-operation is not generated in the first and/or second limit switches 91 and 92 or after the message is transmitted.

In detail, in S151, the microcomputer 90 decides whether the operation signal is inputted from the indoor unit. When the microcomputer 90 does not receive the operation signal from the indoor unit, the outdoor unit 10 needs not to be operated. In S152, the microcomputer 90 transmits an operation command of completely closing the louver blades 8 to the driving member 200 to protect the components of the outdoor unit 10 (compressor, condenser, cooling fan, etc.). The driving member 200 controls the louver blade member 100 to completely close the louver blades 8.

In S153, when the microcomputer 90 receives the operation signal from the indoor unit, the microcomputer 90 decides whether the overload current generation signal notifying overload of the driving member is inputted from the current transformer 94 connected to the driving member 200. When receiving the overload current generation signal from the current transformer 94, the microcomputer 90 transmits an operation command of completely opening the louver blades 8 to the driving member 200 to perform the whole operation of the outdoor unit 10. The driving member 200 completely opens the louver blades 8 (S155).

In S154, when the microcomputer 90 does not receive the overload current generation signal from the current transformer 94, the microcomputer 90 decides whether the mis-operation is generated, for example, in the first and/or second limit switches 91 and 92 among the sensors relating to the operation of the louver blades 8 of the outdoor unit 10. When the mis-operation is generated in the first and/or second limit switches 91 and 92, the microcomputer 90 transmits an operation command of completely opening the louver blades 8 to the driving member 200 to perform the whole operation of the outdoor unit 10. The driving member 200 completely opens the louver blades 8.

In S155, the microcomputer 90 completely opens the louver blades 8. In S156, when the microcomputer 90 receives the overload current generation signal from the current transformer 94 and opens the louver blades 8 in S155, the microcomputer 90 transmits an overload current generation message to the indoor unit, and when the microcomputer 90 decides that the mis-operation is generated in the first and/or second limit switches 91 and 92 and opens the louver blades 8 in S155, the microcomputer 90 transmits a mis-operation message to the indoor unit.

In S157, the microcomputer 90 normally operates the outdoor unit 10. That is, the microcomputer 90 completely opens the louver blades 8, and normally operates the other components of the outdoor unit 10 to prevent errors due to the driving member 200 for driving the louver blades 8 and the sensors relating to the operation of the louver blades 8.

Figure 16:
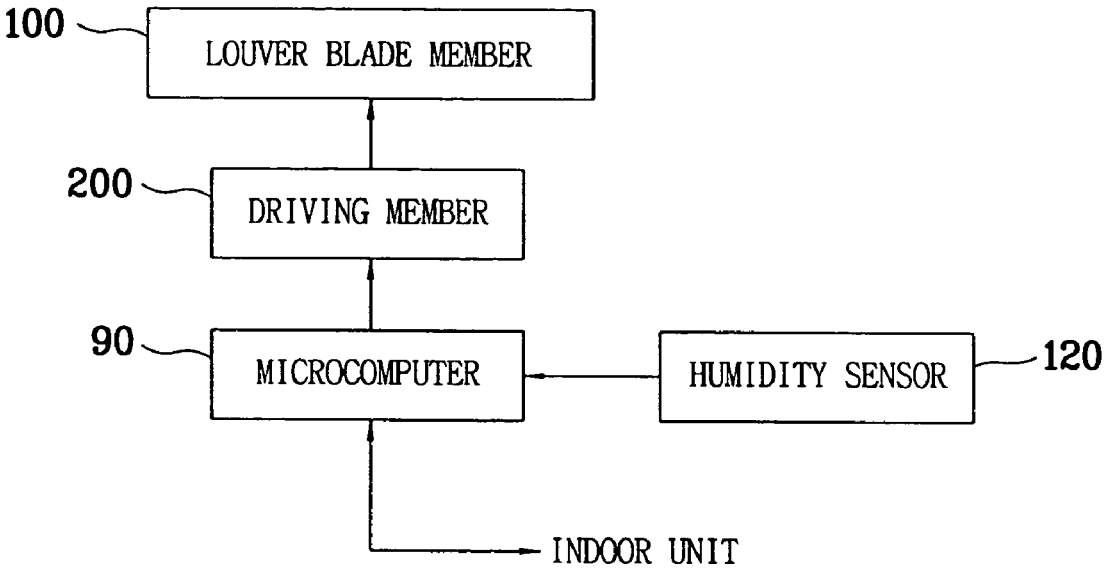
FIG. 16 is a structure view illustrating an apparatus for controlling louver blades of an outdoor unit in accordance with a fourth embodiment of the present invention.

FIG. 16 is a structure view illustrating an apparatus for controlling louver blades of an outdoor unit in accordance with a fourth embodiment of the present invention. Referring to FIG. 16, the apparatus includes a louver blade member 100 for opening and closing suction and discharge units 11*a* and 11*b* of the outdoor unit, a driving member 200 for opening and closing the louver blade member 100 within a certain critical angle range, a humidity sensor 120 installed inside or outside the outdoor unit 10, for measuring external humidity of the outdoor unit 10, and a microcomputer 90 for receiving the current humidity from the humidity sensor 120, and allowing the driving member 200 to operate the louver blade member 100 according to the current humidity to open the louver blades 8 at a certain angle and close the louver blades 8.

The microcomputer 90 compares the current humidity inputted from the humidity sensor 120 with reference humidity stored in an internal memory (not shown). When the current humidity is higher than the reference humidity, the microcomputer 90 regards a current weather as a rainy or very cloudy day, and when the current humidity is equal to or lower than the reference humidity, the microcomputer 90 regards the current weather as a sunny or slightly cloudy day.

In addition, the microcomputer 90 is connected to perform bidirectional communication with an indoor unit (not shown).

The reference humidity stored in the memory of the microcomputer 90 is set to have a different value according to a season. For more accurate decision, different rainy weather standards are used in each season.

Figure 17:
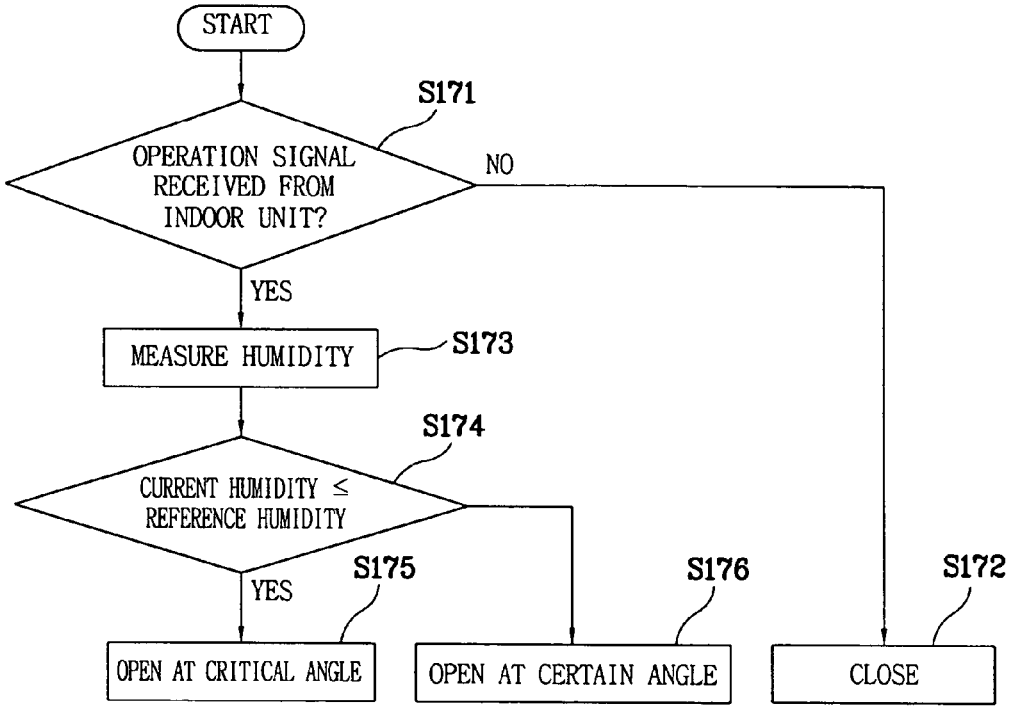
FIG. 17 is a flowchart showing a method for controlling the louver blades of the outdoor unit in accordance with the fourth embodiment of the present invention.

FIG. 17 is a flowchart showing a method for controlling the louver blades of the outdoor unit in accordance with the fourth embodiment of the present invention. The method of FIG. 17 is performed by the apparatus of FIG. 16, or other apparatuses performing similar operations.

The method performs a step S171 for deciding whether an operation signal is inputted from the indoor unit, a step S172 for allowing the driving member 200 to close the louver blade member 100 when the operation signal is not inputted from the indoor unit, a step S173 for receiving the current humidity measured by the humidity sensor 120 when the operation signal is inputted from the indoor unit, a step S174 for comparing the current humidity with the reference humidity, a step S175 for allowing the driving member 200 to open the louver blades 8 at a critical angle when the current humidity is equal to or lower than the reference humidity, and a step S176 for allowing the driving member 200 to open the louver blades 8 at an angle smaller than the critical angle when the current humidity is higher than the reference humidity.

In detail, in S171, the microcomputer 90 decides whether the operation signal is inputted from the indoor unit. The operation signal may be a power on signal from the indoor unit.

In S173, the microcomputer 90 receives the current humidity from the humidity sensor 120, and reads the reference humidity of the season of the current date from the memory before going to S174.

In S174, the microcomputer 90 compares the reference humidity of the current season read from the memory with the current humidity. When the current humidity is equal to or lower than the reference humidity, the microcomputer 90 regards the current weather as a sunny day, and allows the driving member 200 to open the louver blades 8 at a critical angle (α) (for example 90°) (S175). When the current humidity is higher than the reference humidity, the microcomputer 90 regards the current weather as a rainy day, and allows the driving member 200 to open the louver blades 8 at an angle (β) smaller than the critical angle (α) (for example 45°) (S176).

Figure 18A:
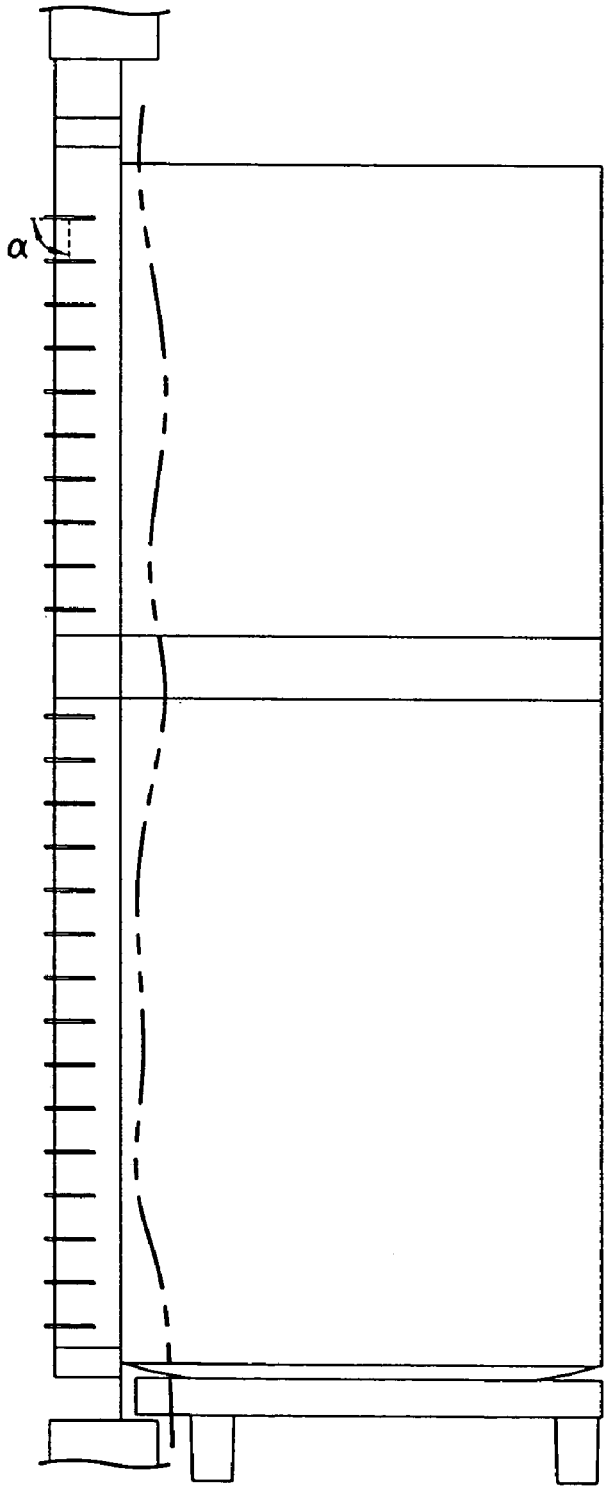
FIGS. 18A to 18C are exemplary views illustrating various open angles of the louver blades.
Figure 18B:
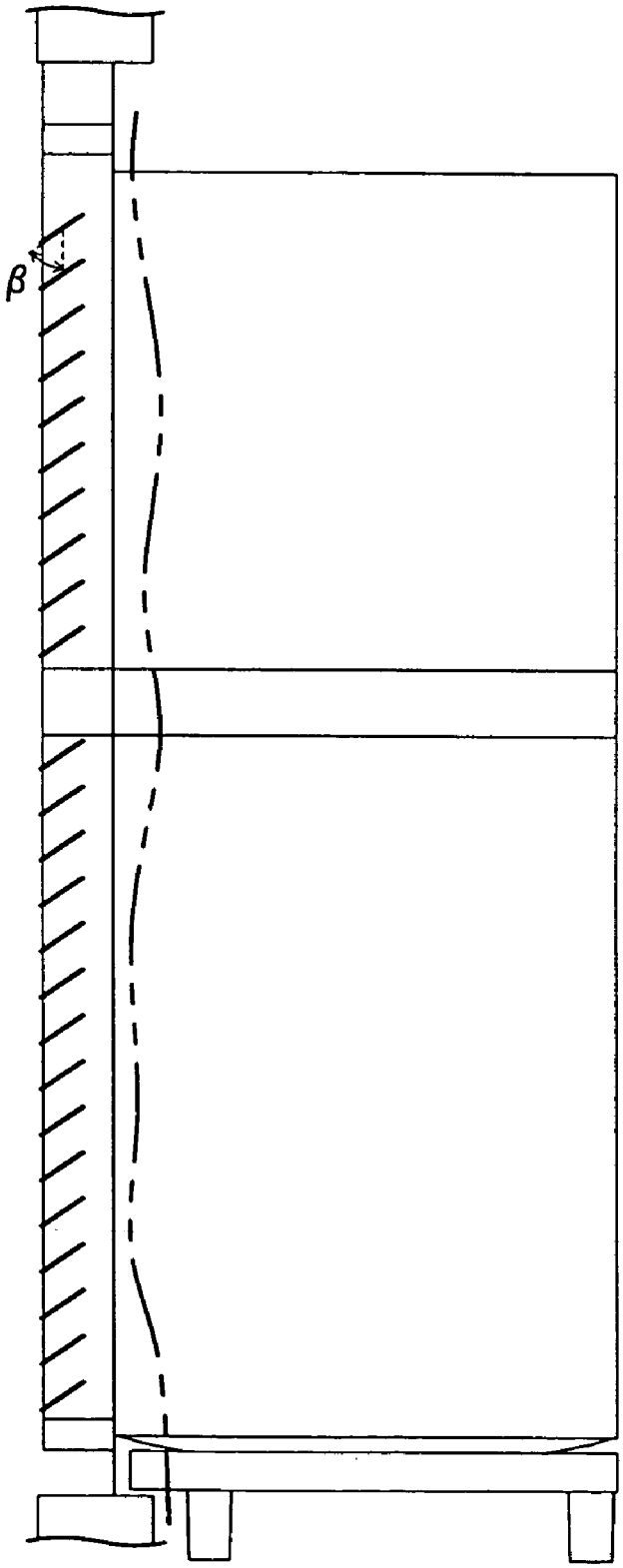
Figure 18C:
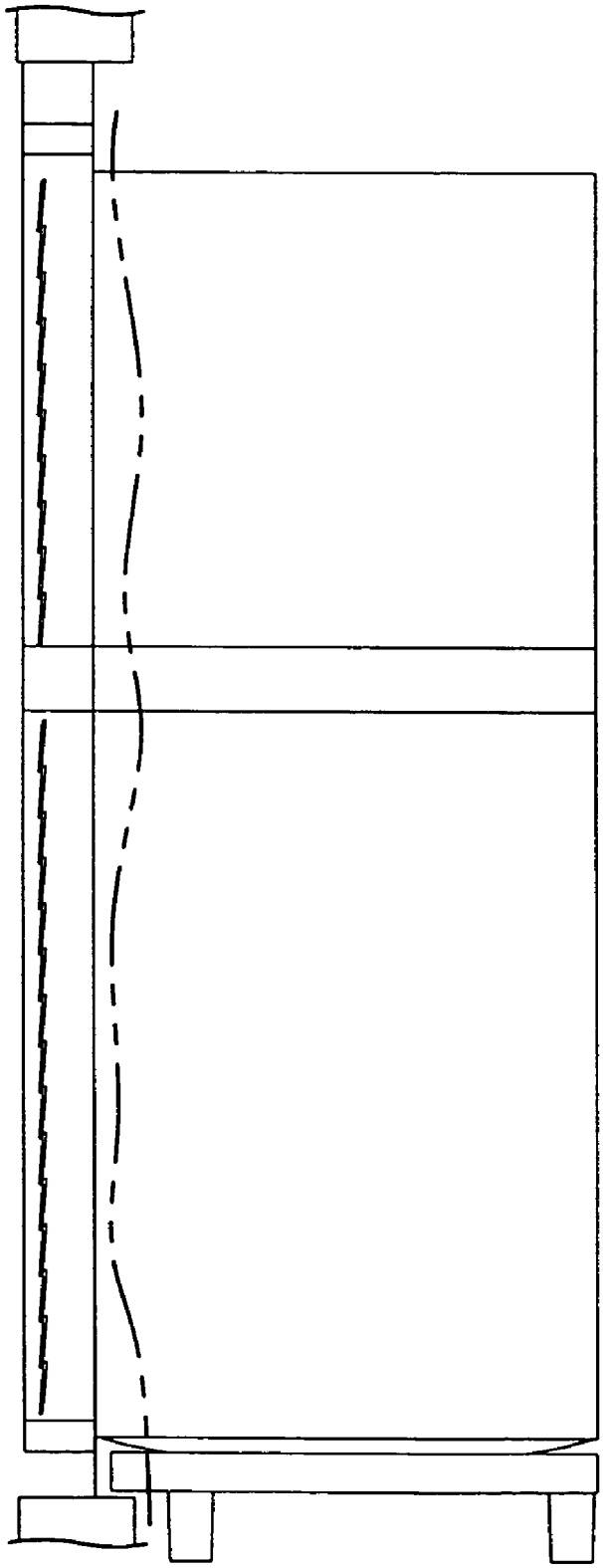

FIGS. 18A to 18C are exemplary views illustrating various open angles of the louver blades.

As shown in FIG. 18A, the microcomputer 90 performs S175 of FIG. 17, and opens the louver blades 8 at a critical angle (α), so that the louver blades 8 of the suction and discharge units 11*a* and 11*b* are not operated as a fan resistance.

As illustrated in FIG. 18B, the microcomputer 90 performs S176 of FIG. 17, and opens the louver blades 8 at an angle (β) which is smaller than the critical angle (α), to prevent rain or snow being inputted through gaps between the louver blades 8 of the suction and discharge units 11*a* and 11*b*, and to minimize a fan resistance by the louver blades 8.

As depicted in FIG. 18C, the microcomputer 90 performs S172 of FIG. 17, and completely closes the louver blades 8. Accordingly, while the outdoor unit 10 is not used, alien substances are not inputted through the gaps between the louver blades 8.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. An apparatus for controlling louver blades of a compressor/condenser unit, comprising:

a louver blade member including a plurality of louver blades;

a driving member configured to open and to close the plurality of louver blades through an operation of the louver blade member;

first and second sensors configured to respectively generate a first contact point signal when the plurality of louver blades are closed and a first end of the louver blade member contacts the first sensor, and a second contact point signal when the plurality of louver blades are open and a second end of the louver blade member contacts the second sensor; and a microcomputer configured to control the driving member, and to determine an open/close state of the plurality of louver blades based on the first contact point signal and/or the second contact point signal from the first and/or second sensors, respectively.

2. The apparatus of claim 1, wherein the microcomputer is connected to a separate indoor unit, and is configured to determine an open/closed state of the plurality of louver blades when it receives an operation signal from the indoor unit.

3. The apparatus of claim 2, wherein the microcomputer determines the open/closed state of the louver blades based on reception of the first contact point signal.

4. The apparatus of claim 3, wherein the microcomputer is configured to operate the driving member to open the plurality of louver blades based on receipt of the operation signal from the indoor unit and the first contact point signal from the first sensor.

5. The apparatus of claim 4, wherein the microcomputer is configured to determine if the second contact point signal is received within a standard re-contact point time after turning off the first sensor, and to determine if the plurality of louver blades are normally opened.

6. The apparatus of claim 5, wherein the microcomputer is configured to transmit an operation state of the plurality of louver blades to the indoor unit based on the determination result.

7. The apparatus of claim 1, wherein the first and second sensors are limit switches.

8. In an apparatus for controlling louver blades of a compressor/condenser unit comprising a plurality of louver blades, and first and second limit switches for generating a first contact point signal when the louver blades are closed, and a second contact point signal when the louver blades are open, a method for controlling the louver blades of the compressor/condenser unit comprising:

receiving the first contact point signal;

deciding an open/closed state of the louver blades according to reception of the first contact point signal;

opening the louver blades according to the decision result; and confirming whether the second contact point signal is input within a standard re-contact point time after turning off the first limit switch, and deciding whether the louver blades are normally opened.

9. The method of claim 8, wherein deciding the open/close state is performed after a separate operation signal is input from an indoor unit.

10. The method of claim 9, further comprising transmitting an operation state to the indoor unit after deciding whether the louver blades are normally opened.

* * * * *